US006169967B1

(12) United States Patent
Dahlem et al.

(10) Patent No.: US 6,169,967 B1
(45) Date of Patent: Jan. 2, 2001

(54) CASCADE METHOD AND APPARATUS FOR PROVIDING ENGINEERED SOLUTIONS FOR A WELL PROGRAMMING PROCESS

(75) Inventors: James Steven Dahlem, Midlothian, TX (US); Paul Ronald Riederer, Aberdeen (GB); Bruno Cuillier, Pua (FR)

(73) Assignee: Dresser Industries, Inc., Dallas, TX (US)

( * ) Notice: Under 35 U.S.C. 154(b), the term of this patent shall be extended for 0 days.

(21) Appl. No.: 09/148,393

(22) Filed: Sep. 4, 1998

(51) Int. Cl.[7] ..... G06G 7/48

(52) U.S. Cl. ..... 703/10; 702/9; 702/6; 702/11

(58) Field of Search ..... 395/500.31; 702/6, 702/9, 11; 705/7, 8, 9; 703/10; 175/61

(56) References Cited

U.S. PATENT DOCUMENTS

| | | | | |
|---|---|---|---|---|
| 4,718,011 | * | 1/1988 | Patterson, Jr. | 702/6 |
| 4,794,534 | * | 12/1988 | Millheim | 395/500.31 |
| 5,216,612 | * | 6/1993 | Cornett et al. | 705/8 |
| 5,305,836 | * | 4/1994 | Holbrook et al. | 175/39 |
| 5,369,570 | * | 11/1994 | Parad | 705/8 |
| 5,660,239 | * | 8/1997 | Mueller | 175/61 |
| 5,704,436 | * | 1/1998 | Smith et al. | 702/6 |
| 5,845,258 | * | 12/1998 | Kennedy | 705/8 |
| 5,963,910 | * | 10/1999 | Ulwick | 705/7 |

OTHER PUBLICATIONS

Glover et al., "New Advances and Applications of Combining Simulation and Optimization", Proc. Winter Simulation Conference, pp. 144–152, Dec. 1996.*

Hill et al., "Intelligent Drilling System for Geological Sensing", Proc. of the IEEE/RSJ Int. Conf. on Intelligent Robots and Systems, vol. 1, pp. 495 –501, Jul. 1993.*

Hancke et al., "A Control System for Optimizing Deep Hole Drilling Conditions", Proc. IECON Inter. Conf. on Industrial Electronics, Control and Instrument. vol. 3, pp. 2279–2284, Nov. 1991.*

Don Murphy, "Selecting The Right Rotary Bit Is The Place To Smart Cutting Costs", The Oils & Gas Journal, Feb. 3, 1969, pp. 88–92.

R.A. Jackson, "Cost/Foot: Key To Economic Selection Of Rock Bits", World Oil, Jun. 1972, pp. 83–85.

Jack C. Estes, "Guidlines For Selecting Rotary Insert Rock Bit", Petroleum Engineer, Sep. 1974, pp. 30–34.

Robert Chambers and Billy Gardner, "Drilling Man's Guide To Better Bit Selection", Petroleum Engineer, Jun. 1982, pp. 100–108.

K.L. Mason, "Tricone Bit Selection Using Sonic Logs", SPE 13256, 1984, pp. 172–181.

(List continued on next page.)

*Primary Examiner*—Kevin J. Teska
*Assistant Examiner*—Douglas W. Sergent
(74) *Attorney, Agent, or Firm*—Haynes and Boone, LLP

(57) ABSTRACT

A method and system for engineering a drilling bit program linked to rock removal at a cutting element/formation interface and specific to drilling of one or more wells in a given geographic area is disclosed. The system includes a first arrangement for planning the drilling of a particular well based upon a cascaded planning input and providing an engineered output which is a function of the cascaded planning input, wherein a level of the engineered output being dependent upon a level of the cascaded planning input. A second arrangement is provided for implementing the engineered output in the drilling of the particular well is also provided. Lastly, a third arrangement is provided for evaluating the implementation of the engineered output for the drilling of the particular well and providing an evaluation output. The evaluation output can be used by the planning arrangement as additional planning input for planning the drilling of a subsequent well in the geographic area.

8 Claims, 9 Drawing Sheets

OTHER PUBLICATIONS

T. Novig, "Factors Affecting Rock Bit Selection", Oil Gas Magazine Apr. 1988.

W. Soemodihardjo and S. Rachmat, "Application Of An Expert System To Rotary Drilling Bit Selection", 1st Victorian Dep. of Manufacturing Ind. Dev., Nov. 1991, pp. II–17 through II–40.

G.M. Efendiyev, N.M. Djafarova and R.D. Djevanshir, "The Optimum Decision In Cutting–Type Drilling Bits Selection With Regard To Their Operating Conditions And The Vagueness Of The Task Pose", Energy Sources, vol. 13, 1991, pp. 243–250.

"Adavanced Bit Engineering, Selection Lowers Drilling Cost", Petroleum Engineer, Sep. 1993, No. 9, vol. 65, p. 3.

J.L. Falcao, E.E. Maidia, C.F. Dumans and J.F. Dezen, "PDC Bit Selection Through Cost Prediction Estimates Using Crossplots And Sonic Log Data", SPE/IADC 25733, 1993, pp. 525–535.

R.C. Pessler, M.J. Fear and M.R. Wells, "Different Shales Dictate Fundamentally Different Strategies In Hydraulics, Bit Selection, And Operating Practices", SPE 28322, 1994, pp. 307–318.

Shrikant Tiwari, "Dull Bit Grading And Rock Strength Analysis Key To Bit Selection", Oil & Gas Journal, Dec. 5, 1994, pp. 45–51.

J.R. Spaar, L.W. Ledgerwood, Harvey Goodman and T.J. Moo, "Formation Compressive Strength Estimates For Predicting Drillability And PDC Bit Selection", SPE/IADC 29397, 1995, pp. 569–578.

A. Hameed and A. Al–Rushaid, "Deep Wells Bit Optimization", SPE/IADC 39269, 1997, pp. 197–203.

V.P. Perrin, Graham Mensa–Wilmot and W.L. Alexander, "Drilling Index–A New Approach To Bit Performance Evaluation", SPE/IADC 37595, 1997, pp. 199–205.

F.J.N. de Castro, S.A.B. da Fontoura, L.C. de Albuquerque, M. Frydman and C.F.F. Dumans, "Evaluation Of Drill Bit Performance Taking Into Account The In Situ State Of Stress", SPE International, 1997, pp. 1–8.

Robert T. Fabian, "In Situ Compressive Strength Analysis As An Aid In Fixed Cutter Bit Selection And Performance", ASME International, 1997, pp. 86–94.

H. Xu, T.Tochkawa and T. Hatakeyama, "A Method For Bit Selection By Modelling ROP And Bit–Life", The Petroleum Society, Paper 97–78, pp. 1–8.

Security DBS, "Design At The Customer Interface", brochure 1997.

* cited by examiner

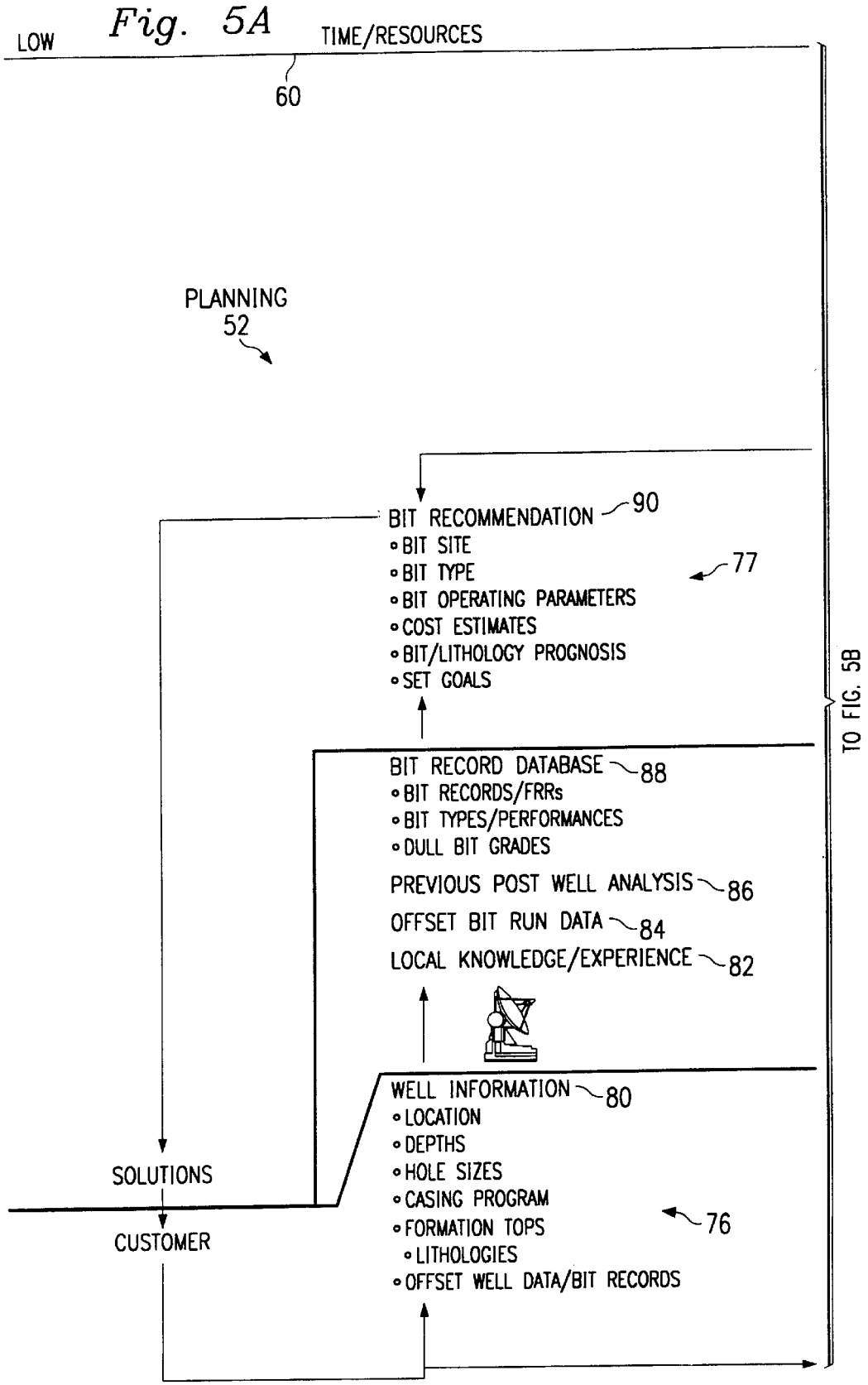
Fig. 5A
LOW
TIME/RESOURCES
60
PLANNING
52
BIT RECOMMENDATION
90
BIT SITE
BIT TYPE
BIT OPERATING PARAMETERS
COST ESTIMATES
BIT/LITHOLOGY PROGNOSIS
SET GOALS
77
BIT RECORD DATABASE
88
BIT RECORDS/FRRs
BIT TYPES/PERFORMANCES
DULL BIT GRADES
PREVIOUS POST WELL ANALYSIS
86
OFFSET BIT RUN DATA
84
LOCAL KNOWLEDGE/EXPERIENCE
82
WELL INFORMATION
80
LOCATION
DEPTHS
HOLE SIZES
CASING PROGRAM
FORMATION TOPS
LITHOLOGIES
OFFSET WELL DATA/BIT RECORDS
76
SOLUTIONS
CUSTOMER
TO FIG. 5B

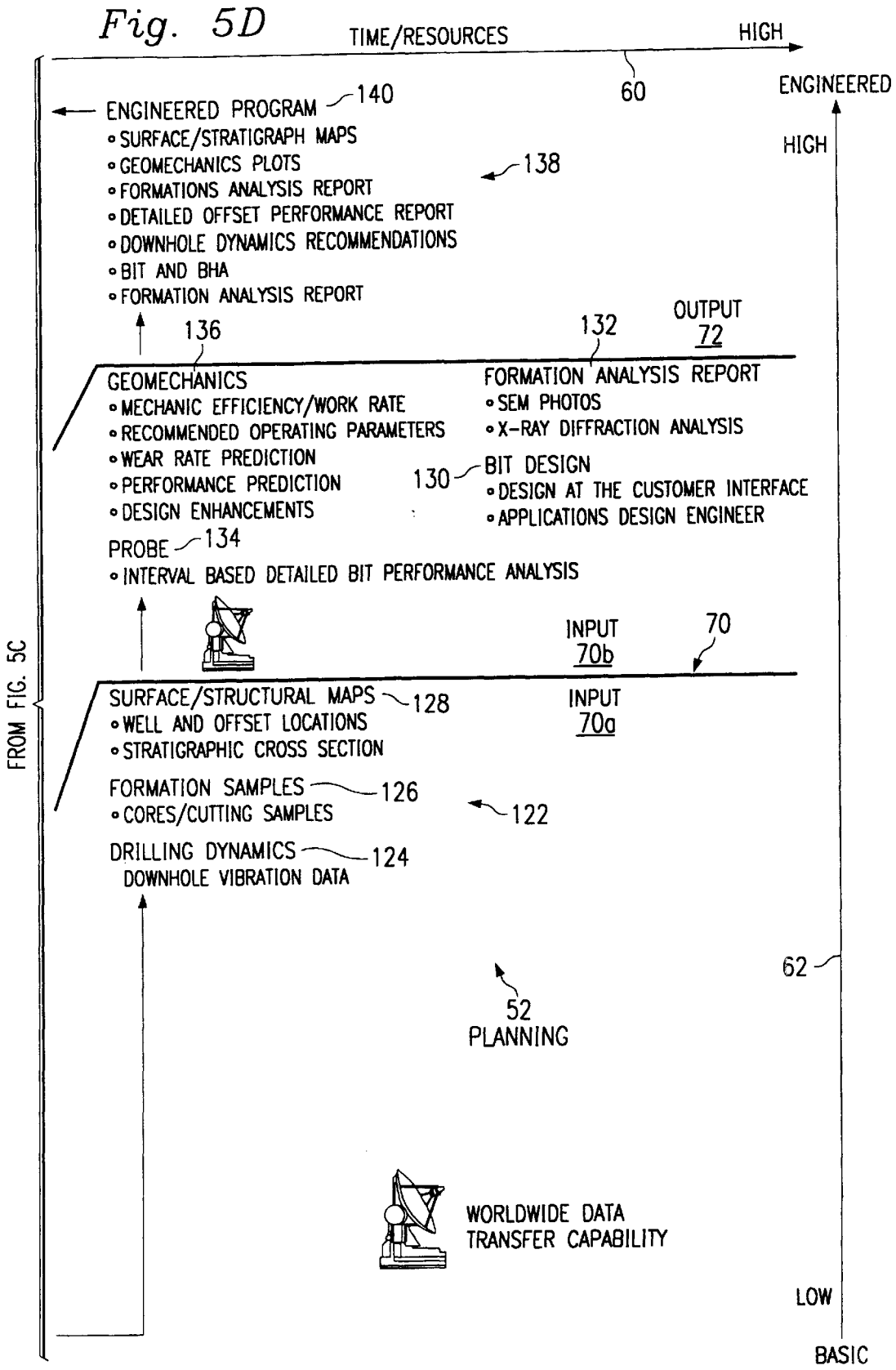
Fig. 5D
TIME/RESOURCES
HIGH
60
ENGINEERED
HIGH
ENGINEERED PROGRAM
140
• SURFACE/STRATIGRAPH MAPS
• GEOMECHANICS PLOTS
• FORMATIONS ANALYSIS REPORT
• DETAILED OFFSET PERFORMANCE REPORT
• DOWNHOLE DYNAMICS RECOMMENDATIONS
• BIT AND BHA
• FORMATION ANALYSIS REPORT
138
136
132
OUTPUT
72
GEOMECHANICS
• MECHANIC EFFICIENCY/WORK RATE
• RECOMMENDED OPERATING PARAMETERS
• WEAR RATE PREDICTION
• PERFORMANCE PREDICTION
• DESIGN ENHANCEMENTS
FORMATION ANALYSIS REPORT
• SEM PHOTOS
• X-RAY DIFFRACTION ANALYSIS
130
BIT DESIGN
• DESIGN AT THE CUSTOMER INTERFACE
• APPLICATIONS DESIGN ENGINEER
PROBE
134
• INTERVAL BASED DETAILED BIT PERFORMANCE ANALYSIS
INPUT
70b
70
FROM FIG. 5C
SURFACE/STRUCTURAL MAPS
128
• WELL AND OFFSET LOCATIONS
• STRATIGRAPHIC CROSS SECTION
INPUT
70a
FORMATION SAMPLES
126
• CORES/CUTTING SAMPLES
122
DRILLING DYNAMICS
124
DOWNHOLE VIBRATION DATA
62
52
PLANNING
WORLDWIDE DATA
TRANSFER CAPABILITY
LOW
BASIC

CASCADE METHOD AND APPARATUS FOR PROVIDING ENGINEERED SOLUTIONS FOR A WELL PROGRAMMING PROCESS

BACKGROUND OF THE INVENTION

1. Field of the Invention

The present invention relates generally to a well programming process, and more particularly, to a method and apparatus for providing engineered bit solutions for a well programming process, relating to the rock formation drilling industry.

2. Discussion of the Related Art

Rock bit manufacturing companies have traditionally provided product lines which involve maintaining large inventories of rock bits with the hope that one of those bit designs would best match a customer's application and, thus, solve the customer's problem. Often, however, the incorrect product was selected, applied incorrectly, and any lessons to be learned were ignored. In the late 1980's, Shell Oil Company defined "Drilling in the Nineties" where the Shell Oil Company concluded that it would be advantageous for operators to reach agreements with service companies for a more integrated approach. As a result, operators teamed up with single bit suppliers and limited their vision to the products supplied solely by that one supplier. In view of the teaming up with one supplier, many solutions being developed by other bit manufacturers were not considered or evaluated.

In addition to the above, at a most basic level, a provider of drilling bits is a product-oriented provider, focusing on providing products to the market place. In short, the drilling bit provider designs, manufactures and sells rock bits. Rock bits have traditionally been centrally developed (i.e., at a central location of the bit provider), built, placed in inventory, and then sold substantially as "off the shelf products." Customers (i.e., drilling operators) would use IADC classifications charts to determine and select the bits which the customer believed would be best suited for their specific drilling needs. Each manufacturer of drill bits was responsible for assigning the IADC codes to the bits they designed. As a result, many bits were built simply to fit into a specific IADC code slot. Large inventories of rock bits were required to ensure that any one particular area had enough stock of each IADC code. In addition, bits were designed at the central manufacturing facility, including typically, a specific soft or hard formation design developed for worldwide use. For example, an IADC 517X(S84F) bit originally designed for drilling in South Texas has also been shipped for use in the North Sea or in Southeast Asia, as a standard practice, despite the fact that the bit was not designed for use at either of the later locations.

SUMMARY OF THE INVENTION

The method and apparatus of the present disclosure advantageously provide for an improved engineering of a drilling bit program which overcomes problems in the art as discussed herein.

According to one embodiment, a method for engineering a drilling bit program linked to rock removal at a cutting element/formation interface and specific to drilling of one or more wells in a given geographic area includes the following steps. A first step includes planning the drilling of a particular well based upon a cascaded planning input and providing an engineered output which is a function of the cascaded planning input, a level of the engineered output being dependent upon a level of the cascaded planning input. A second step includes implementing the engineered output in the drilling of the particular well. Lastly, a third step includes evaluating the implementation of the engineered output for the drilling of the particular well and providing an evaluation output. The evaluation output can be used in the planning step as additional planning input for planning the drilling of a subsequent well in the geographic area.

According to another embodiment, a system for engineering a drilling bit program linked to rock removal at a cutting element/formation interface and specific to drilling of one or more wells in a given geographic area includes a first means for planning the drilling of a particular well based upon a cascaded planning input and providing an engineered output which is a function of the cascaded planning input, a level of the engineered output being dependent upon a level of the cascaded planning input. A second means is provided for implementing the engineered output in the drilling of the particular well. Lastly, a third means is provided for evaluating the implementation of the engineered output for the drilling of the particular well and providing an evaluation output, wherein the evaluation output can be used by the planning means as additional planning input for planning the drilling of a subsequent well in the geographic area.

BRIEF DESCRIPTION OF THE DRAWINGS

The foregoing and other teachings and advantages of the present invention will become more apparent upon a detailed description of the best mode for carrying out the invention as rendered below. In the description to follow, reference will be made to the accompanying drawings, in which.

DETAILED DESCRIPTION OF THE PREFERRED EMBODIMENTS

The method and apparatus of the present disclosure enable a service and knowledge based drilling services company to provide effective engineered bit program solutions to it's drilling operator customers. The method and apparatus of the present disclosure provide multiple levels of drilling service to a drilling operator customer, each advance level involving a greater dedication of resources and involvement than a previous level. Each level is also determined in part by a degree of input from the customer.

Figure 1:
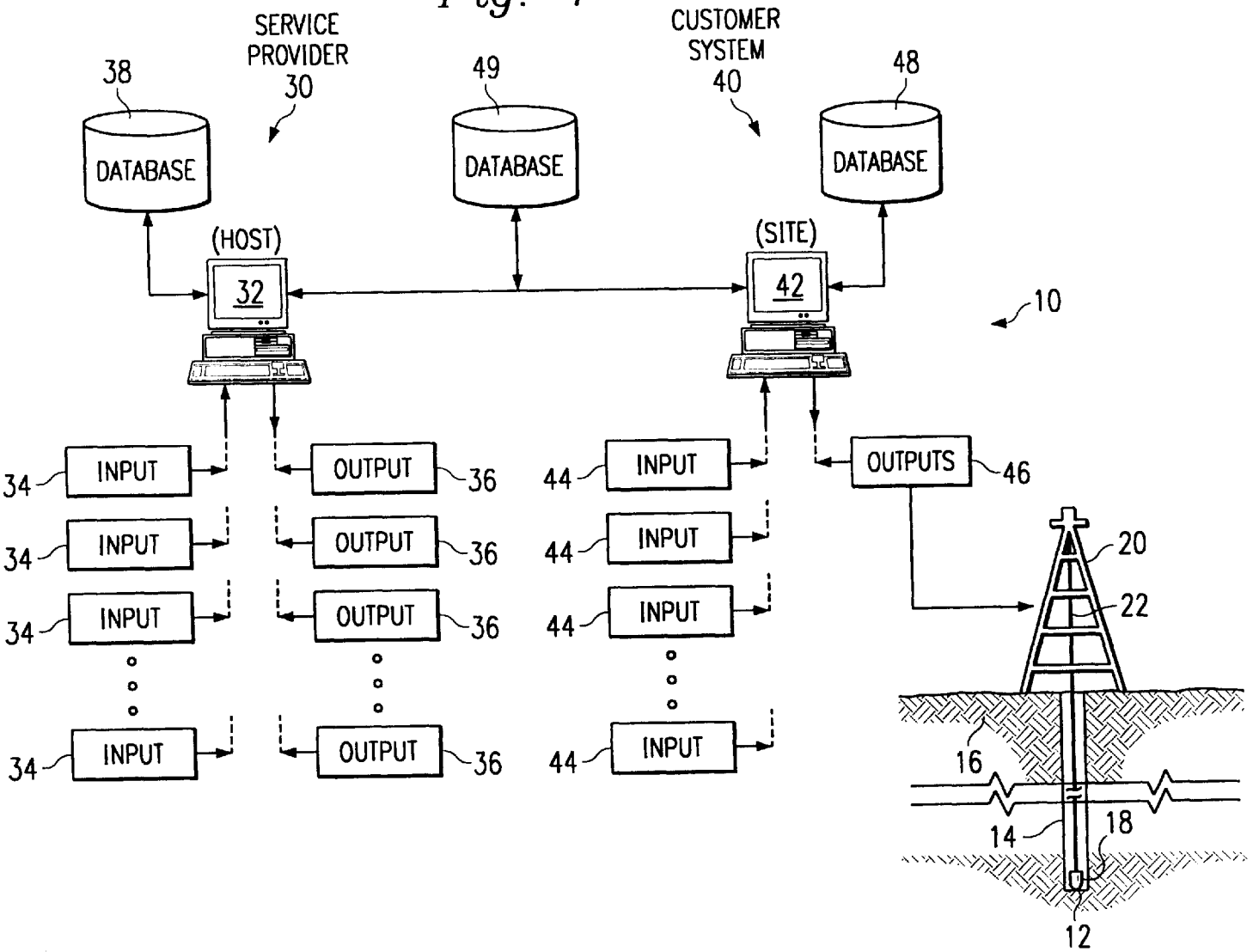
FIG. 1 illustrates a system for engineering a drilling bit program according to the present disclosure.

With reference now to FIG. 1, in accordance with an embodiment of the present disclosure, a system 10 is provided for engineering a drilling bit program linked to rock removal at a cutting element/formation interface 12. The engineered drilling bit program is specific to drilling of one or more wells 14 (only one is shown for simplicity) in a given geographic area 16. FIG. 1 illustrates the drilling of one or more wells 14, including drilling with the use of a prescribed drilling bit 18 according to the engineered bit program of the present disclosure. A drilling rig 20 and drill string 22 are also illustrated. Other apparatus such as mud program instrumentation and hydraulics (not shown) may also be included, such other apparatus including drilling apparatus known in the art and only briefly discussed herein.

Referring still to FIG. 1, system 10 includes a service provider system 30 and a customer system 40. The service provider system 30 includes a computer 32, or the like, which is programmable for carrying out desired functions as described and discussed herein below. Service provider system 30 is adapted for receiving a number of inputs 34 and for outputting a number of outputs 36. Service provider system 30 further includes a database 38, wherein the database is for storage and manipulation of service provider information relating to the engineering of a drilling bit program as further discussed herein below. The service provider database 38 is coupled to service provider computer 32.

The customer system 40 includes a computer 42, or the like, for use in carrying out desired functions as described and discussed herein below. The customer system 40 is adapted for receiving a number of inputs 44 and for outputting one or more outputs 46 for use in the drilling of a particular well in conjunction with the engineered bit program of the present disclosure. A customer database 48 is also included for the storage of customer information specific to the customer's drilling operation or operations, etc. The customer database 48 is coupled to the customer computer 42.

In addition to the service provider system 30 and the customer system 40, a supplemental database 49, is provided for storage and retrieval of geological information, such as may be available from universities or other sources of geological information. As shown, the service provider system 30 is preferably linked to the customer system 40 and also to the supplemental database 49 via any suitable communication link, such as an Internet, Intranet, or other communication link. As a result, information is able to be sent and received as needed between service provider system 30, customer system 40, and the supplemental database 49.

The present method and system apparatus for engineering a drilling bit program will now be discussed with the use of the acronym CASCADE. CASCADE has been defined herein as Customer Aimed Solutions through Comprehensive Applications Design Engineering. CASCADE includes a three-phase process encompassing planning, implementation, and evaluation at every level of service provided. CASCADE retains a flexibility to change according to a customer's requirements. In essence, CASCADE allows for the customizing of an engineered bit program to the changing needs of a customer over time. CASCADE also maps out the process by which a service provider can effectively offer the best engineered solution in the most timely manner to a drilling operator or customer. CASCADE also ensures that the drilling operator is the driving force behind changes in technology and, as such, is the first to benefit from the solutions developed from the engineered drilling program method and system apparatus of the present disclosure.

As discussed herein below, the engineered bit program method and apparatus of the present disclosure is further described in conjunction with a set of guiding principles. Specific tools used in the overall CASCADE process to deliver engineered bit program solutions are also identified. Lastly, implementation of an engineered bit program with CASCADE at an operations level is discussed. Throughout the following discussion, reference can be made with respect to engineered bit program process illustrations as shown in FIGS. 4–7.

Each step or phase of the CASCADE process includes a number of levels. To better understand the levels, the CASCADE process is discussed in conjunction with various tools for implementing the CASCADE process. With respect to the CASCADE tools, the tools include design at the customer interface (DatCI), GeoMechanicsm drilling analysis tools, PLANIT well planning and reporting system tools, and other tools discussed further herein below. In general, to use each respective tool, one would require an initial training, followed by actual field use training in an operational setting while performing respective job functions, further as discussed herein below.

To ensure improved quality and efficient solutions, the method and system apparatus for engineering a drilling bit program according to the present disclosure advantageously provides focus placed upon the customer and the customer's specific application. This is in contrast to the building of drill bit products simply to meet a specific IADC code. The CASCADE process thus enables a product-based drilling services company to be more than just a product-based company. That is, the CASCADE process enables a product-based company to become a service-based and knowledge-based company. In particular, the product, or drill bit, becomes an element of the drilling solution. In addition, transitioning from a pure product-based company to a service-based and knowledge-based company can be appropriately described as implementing a better way of doing business. The better way of doing business ensures that the drilling service provider's focus is centered on providing engineered bit programming solutions to meet a drilling operator's drilling and evaluation needs. CASCADE and the better way of doing business are synonymous in that CASCADE defines the process and a better way of doing business is the direct result.

Principles which can be followed to assist a drilling service provider transition towards implementing an engineering of a drilling bit program of the present disclosure shall now be briefly discussed. A first principle includes inside selling by the service provider. Whenever possible, it is most desirable for at least one representative of the service provider to office with the drilling operator or customer. At another end of the spectrum, the at least one representative may include a full team, including an applications design engineer (ADE), technical analyst (TA), drilling technician (DT), and a logistics coordinator. The at least one representative would reside within the customer's facility and be fully dedicated to the customer's drilling operation. In other circumstances, an ADE or TA may spend one day per week in the customer's office, utilizing the customer's information and the service provider's tools in the process of engineering a drilling bit program, to develop engineered bit drilling solutions.

A second principle includes providing knowledge and service. While a drilling service provider may be recognized as a supplier of quality rock bit products, the rock bit does not remain the focus of the relationship with the drilling operator or customer. Rather, it is desirable for the drilling service provider to be recognized and valued first for its abilities as a service and knowledge provider. The present method of engineering a drilling bit program includes a comprehensive and systematic process which enables a drilling service provider to be recognized and valued as being capable of providing a "best in class" service.

Another principle is providing rig site service. With rig site service, the value of utilizing drilling technicians (DTs) can be readily recognized. A highly engineered drilling solution or new product run downhole and left to the variables of daily rig operations has, in the past, left unanswered questions about why something failed. The use of DTs is aimed to shorten learning cycles, hence decreasing a number of non-performances, in addition to reducing other requirements, for example, such as making price adjustments. Determination of whether or not a DT should be utilized is envisioned as a part of a risk/value assessment of a particular project or drilling program. Certain circumstances, such as entering a major new field or introducing new products will nearly always dictate using a drilling technician.

Yet another principle is value sharing. A service provider can provide economic benefit to a drilling operator customer through value sharing. That is, the value charged for services can be based on economics of an overall drilling program and not merely the standard cost of a particular product. Consideration can be given to such things as savings to a customer, resources and tools utilized, asset cost, and risk of future value. In practical terms, this could mean that for the engineering of a drilling bit program in a well known region where minimal resource and risk are involved, a medium margin on asset cost might be acceptable. As one moves up the levels or steps of the CASCADE process to more highly engineered solutions, for example, involving DatCI, GeoMechanics™, DTs, and higher risk as well as generating an overall higher savings to the drilling operator or customer, a higher margin expectation on asset cost may be acceptable.

Still another principle is asset utilization. In appropriate instances, maintaining an ownership of the service provider's product by the service provider and contracting to drill a complete well or section advantageously enables the service provider greater flexibility to utilize a particular product in a prescribed manner during the engineering of a drilling bit program.

Lastly, a final principle is closing the loop. Planning and implementing are valuable steps and skill sets which should be adequately utilized by the service provider in the engineering of a drilling bit program, however, the two are not enough. Post well and project evaluation are also important. In conjunction with the method and system apparatus for engineering a drilling bit program according to the present disclosure, evaluating the results of planning and implementing of an engineered bit solution are now more readily performed. The evaluation is critical to a subsequent planning cycle, for example, in the continuation of the drilling of an existing well or in the drilling of a new well.

To successfully achieve the goals and to be in line with the guiding principles mentioned above, initiatives can be taken, as appropriate, to ensure that the service provider's focus is centered on providing engineered bit solutions to meet the drilling operator's drilling and evaluation needs. These initiatives, when taken together, are a basis in forming the set of tools which become the backbone of the CASCADE process.

The set of tools which may be used in the engineering of a drilling program according to the present disclosure include one or more of the following. DatCI represents a Design at the Customer Interface process and tool for use in the designing of a rock bit. DatCI is commercially available from SecurityDBS, a Division of Dresser Industries, Inc., of Dallas, Tex. The product development cycle time for new drill bit designs can be significantly reduced with the use of DatCI. DatCI provides for improving the response time for new technology development, job specific design modifications, and product delivery to the particular rig. Design at the customer interface is made possible by moving the bit design function closer to the customer and the customer's rig. That is, through DatCI, the design function for new product designs is decentralized, preferably worldwide. As a result, manufacturing, engineering, and logistics functions of the drill bit service provider are combined to further shorten and customer-orient an entire design, manufacturing, and product delivery process of the service provider.

To further assist in the engineering of a drilling bit program, an application design engineer or ADE may be used. Located in strategic locations, the ADE performs the functions of application analysis, drill bit design, and product evaluation. The ADE strives to satisfy the drilling operator's requirements for bit developments that deliver continuous improvement in drilling performance and the ability to drill new applications. In addition, to assist in the engineering of a drilling bit program, a technical analyst or TA may be used. The TA assists the ADE and other operations personnel in product and market development according to a prescribed objective, as prioritized, for example, by an area business unit of the service provider company. The TA is closely associated with data analysis and optimized drilling practices. Still further, training for ADEs and TAs in the application engineering fields can be provided, for example, through a suitable applications engineering course or AEC.

Another tool used in the engineering of a drilling bit program according to the present disclosure includes a GeoMechanics™ drilling analysis system. GeoMechanics™ is a trademark registered to Dresser Industries of Dallas, Tex. and identifies goods associated with comprehensive drilling analysis systems and equipment. The GeoMechanics™ brand of drilling analysis equipment includes analysis software, the analysis software being an important design tool for the ADE. Various embodiments of drilling analysis equipment are disclosed in U.S. Pat. No. 5,704,436 entitled "METHOD OF REGULATING DRILLING CONDITIONS APPLIED TO A WELL BIT, issued Jan. 1, 1998; U.S. Pat. No. 5,767,399 entitled "METHOD OF ASSAYING COMPRESSIVE STRENGTH OF ROCK", issued Jun. 16, 1998; U.S. Pat. No. 5,794,720, entitled "METHOD OF ASSAYING DOWNHOLE OCCURRENCES AND CONDITIONS", issued Aug. 18, 1998; and Ser. No. 09/048,360, entitled "METHOD OF ASSAYING DOWNHOLE OCCURRENCES AND CONDITIONS, filed Mar. 26, 1998, all assigned to the assignee of the present disclosure and incorporated herein by reference. The comprehensive drilling analysis package facilitates bit selection, bit run parameters, and bit design. In addition, the drilling analysis package can be used to simulate the drilling of a customer's well on a computer prior to starting actual drilling operations in the field. Awareness of the customer's specific requirements more readily provides for accurate predictions for bit selection and bit performance. Predictions are obtained, in part, by determining an in-situ tri-axial compressive rock strength. Lithology-sensitive logs are also used to drive the drilling analysis system. The lithology-sensitive logs may include lithodensity logs (neutron, density, and gamma ray curves), neutron-density, and sonic logs (sonic and gamma-ray curves).

Yet another tool useful in the engineering of a drilling bit program includes a product performance database system or PPDS. In particular, PPDS is a database system which may include a comprehensive bit record database, the database being made accessible via a suitable communication link, for example, using an Intranet site or the like. The product performance database can feature bit records and individual bit runs. Not only is the bit record database system a comprehensive database, but it also preferably includes an ability to quickly perform some basic product performance analyses such as performance averages, specific energy calculations, and basic hydraulics calculations for any given particular bit or bit runs contained therein.

In addition to the above, other tools may become an integral part of the CASCADE process for the engineering of a drilling bit program. Such other tools may include tools to assist in the generating of well proposals, hydraulics analyses, and other planning activities. One such other tool useful in the engineering of a drilling bit program includes PLANIT. PLANIT is commercially available from Sperry-Sun Drilling Services, Inc., a division of Dresser Industries, Inc., of Dallas Tex. PLANIT is an integrated well planning and reporting system. One component of PLANIT is an engineering applications component which includes modules for hydraulics optimization and other functions. Another component of PLANIT includes a drilling database and reporting system. With PLANIT, drill record reports can be generated for providing an analysis of drilling runs. Still other tools may be useful at the rig site for use during a bit run. In addition, tools for assisting in dull bit evaluation and post well analysis may also be included. These additional tools shall be briefly discussed herein below.

The engineering of a drilling bit program and the CASCADE process of the present disclosure thus includes a method and apparatus by which a service and knowledge-based company can provide a customer with solutions required to more effectively drill a given well of a particular drilling program. As discussed herein, the customer may include, for example, an operating company, drilling contractor, or other drilling service company. In particular, the customer is interested in planning a particular drilling operation, effectively carrying out that plan, and then evaluating the merits/performance of that plan to determine what could be done better for a next well (i.e., the next time).

In practice, CASCADE 50 is a three-phase process encompassing planning 52, implementation 54, and evaluation 56 (see FIGS. 2 and 3) at every possible cascaded level of service. Each phase includes cascaded levels of service and the associated tools used in providing a respective level of service (FIGS. 4–7). For example, in the planning phase 52, the tools are used to develop solutions for the customer in the form of an engineered bit program (FIG. 5). In the implementation phase 54, the tools are used to monitor the progress of the bit or well which is being drilled (FIG. 6). In the evaluation phase 56, tools such as a post well analysis tool are used to evaluate the overall performance of the bit and/or well and to determine what lessons have been learned for the continuation of a present well or for a next well in a drilling program (FIG. 7).

Figure 2:
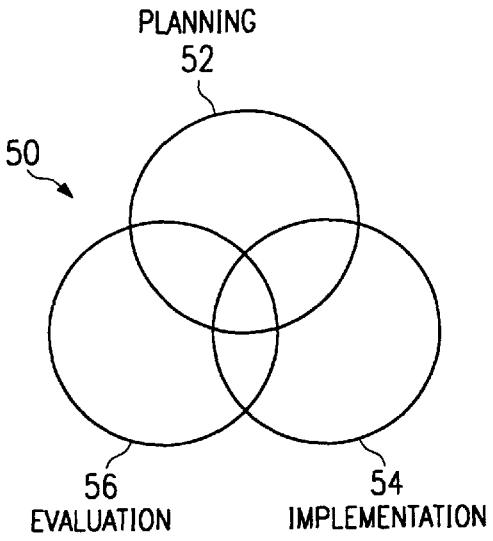
FIG. 2 illustrates an interconnectedness of the planning, implementation, and evaluation phases of the method for engineering a drilling bit program according to the present disclosure.
Figure 3:
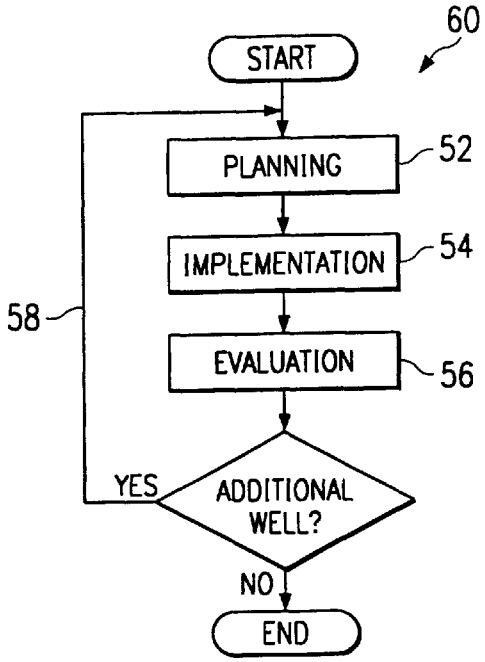
FIG. 3 shows a flow diagram for the engineering of a drilling bit program according to one embodiment of the method and system of the present disclosure.

As can be understood from the above, the phases form a continuous circle or loop 58 where planning leads into implementation, which leads into evaluation, which in turn, leads back into the planning phase (FIG. 2). FIG. 3 shows a flow diagram 60 for the engineering of a drilling program according to one embodiment of the method and system of the present disclosure. All phases are inter-related and directly affect the subsequent phase. As a result, the overall CASCADE process 50 is a continuous and flexible process. No matter what the customer's drilling requirements might be, the CASCADE process 50 provides the tools, training, and focus on service that are required to work closely with the customer to develop an engineered bit solution to the customer's specific problem. These solutions are no longer the "off the shelf" solutions to be marketed worldwide, but are application driven solutions focused on the customer's specific problem or situation.

Figure 4:
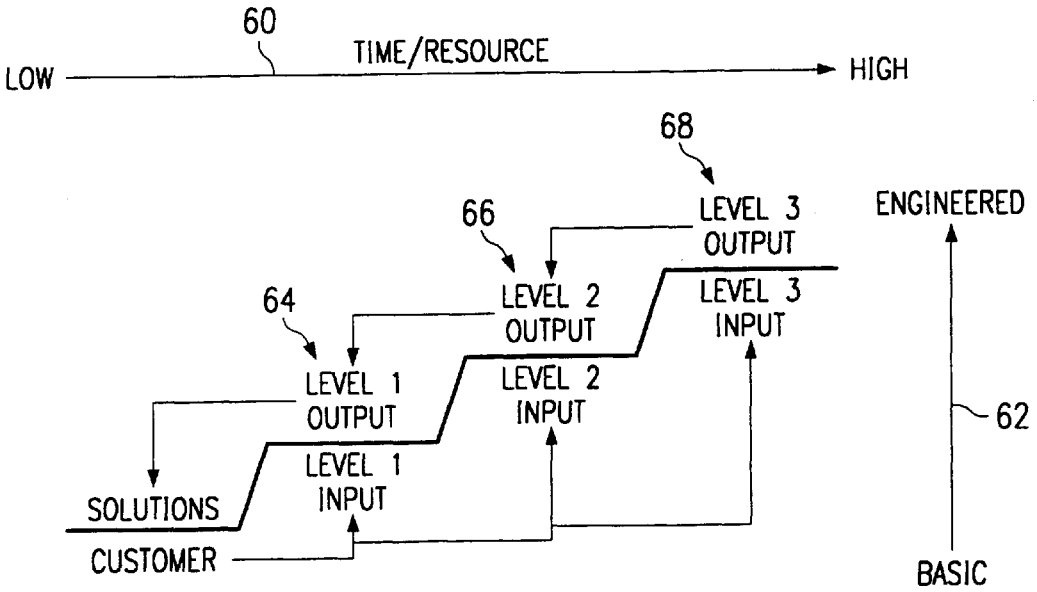
FIG. 4 illustrates a cascaded aspect of each phase of the present method and apparatus for the engineering of a drilling bit program in terms of various levels, the various levels being a function of time and resources required for achieving a desired quality solution or comprehensiveness of service with time and resource ranging from low to high, and a corresponding bit program solution and/or service for the engineered drilling bit program with the bit program solution or service ranging from basic to engineered.
Figure 5B:
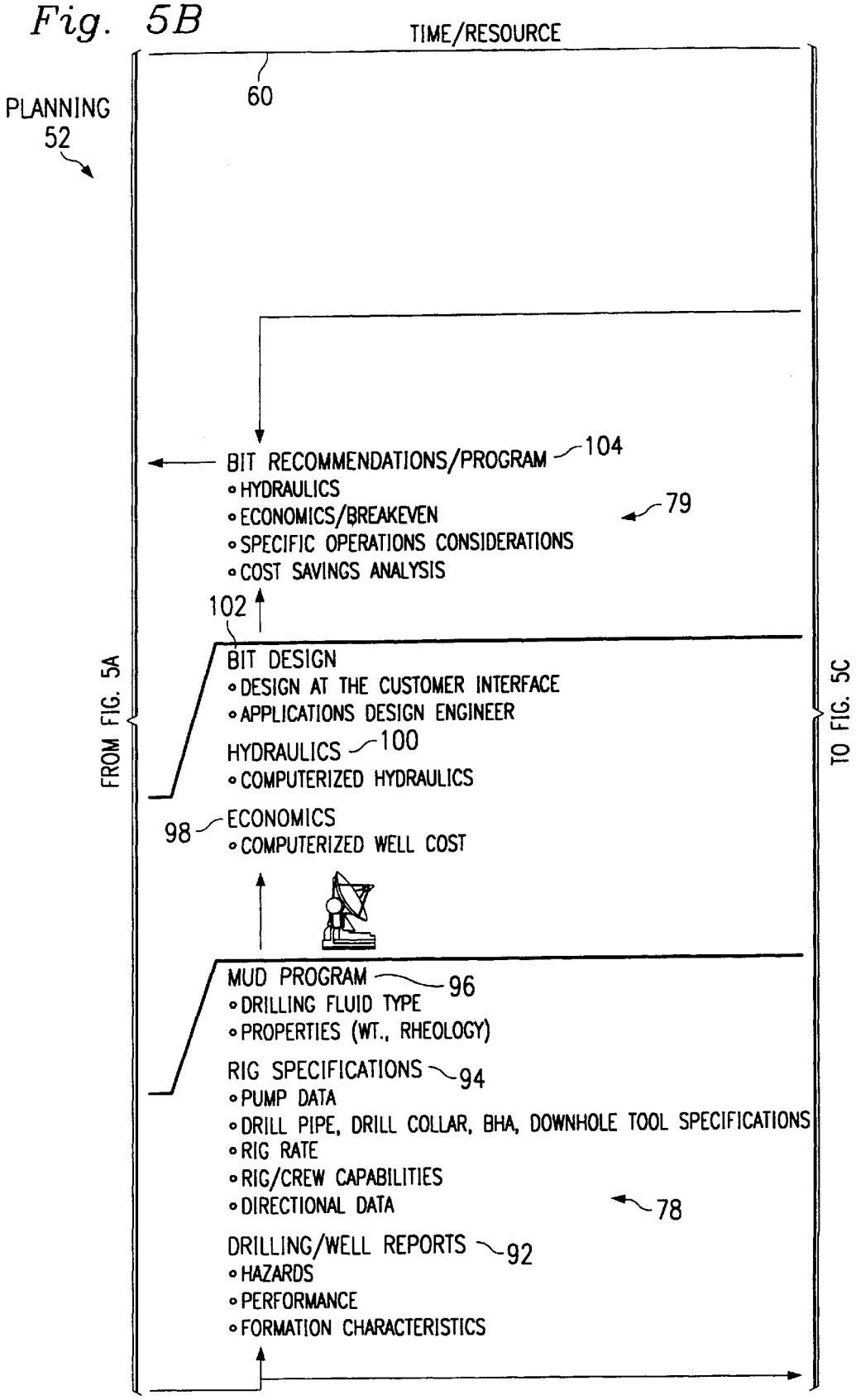
FIG. 5 illustrates an embodiment of the planning phase of the method for engineering a drilling bit program according to the present disclosure.
Figure 5C:
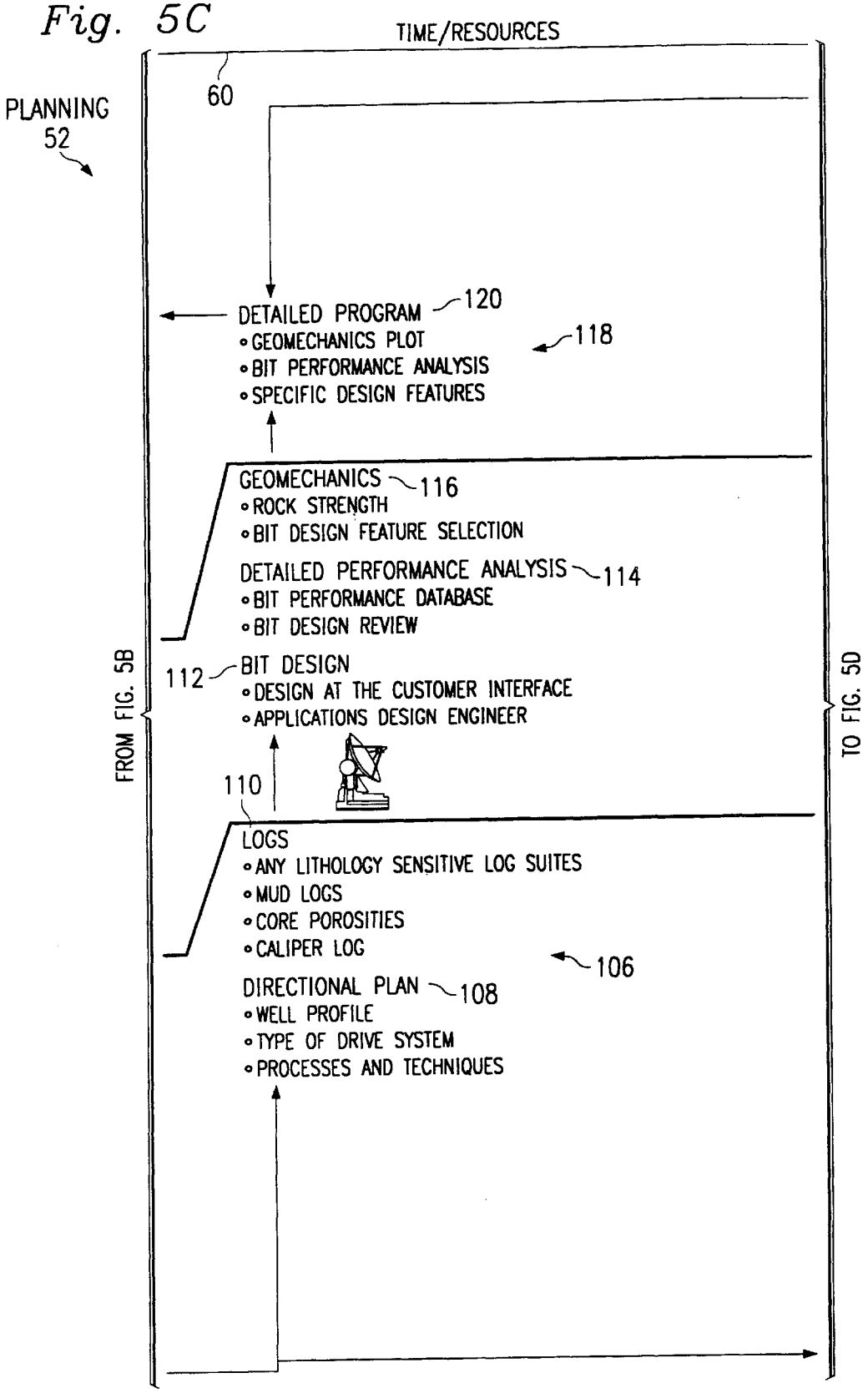
Figure 6:
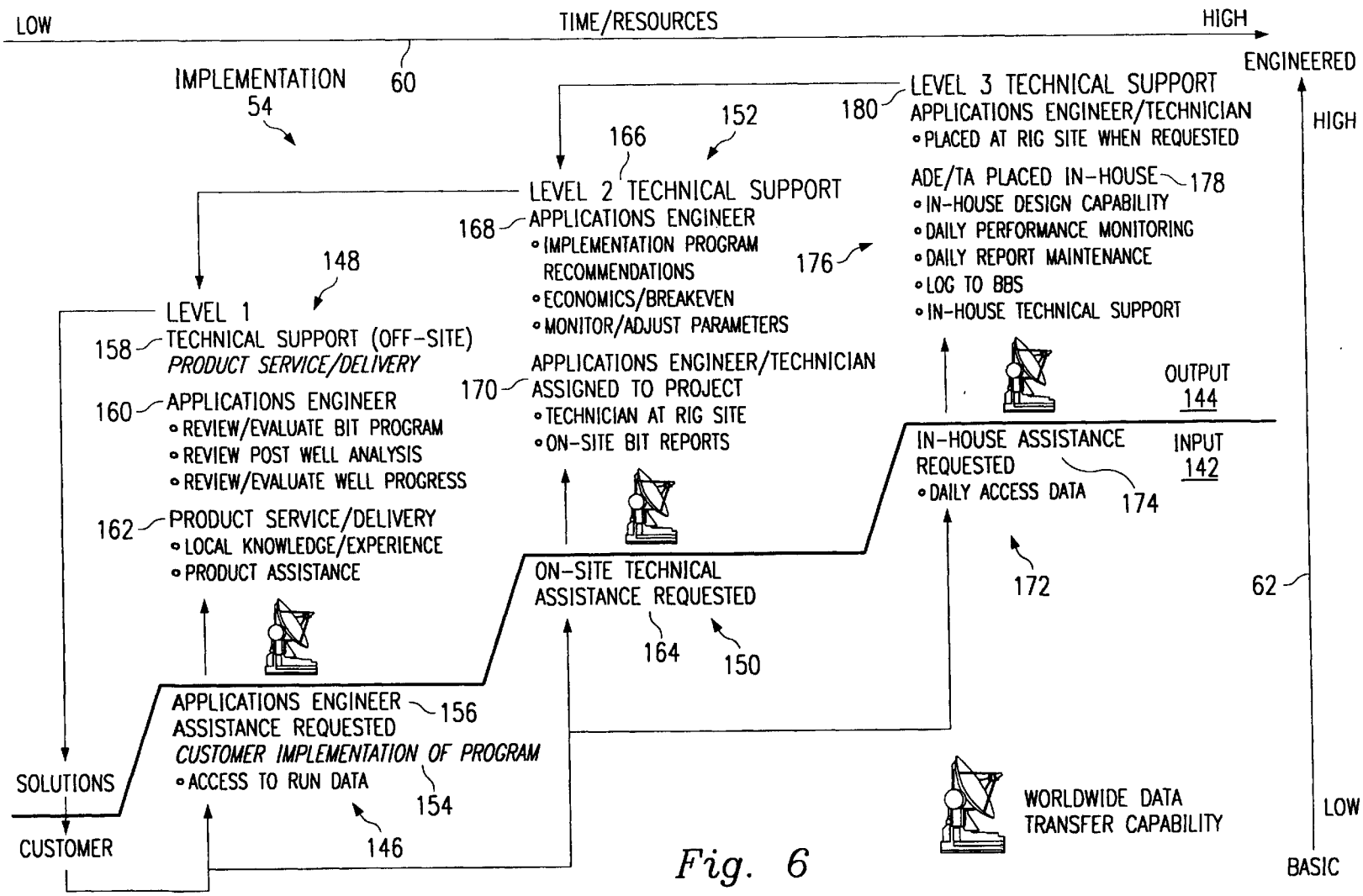
FIG. 6 illustrates an embodiment of the implementation phase of the method for engineering a drilling bit program according to the present disclosure.
Figure 7:
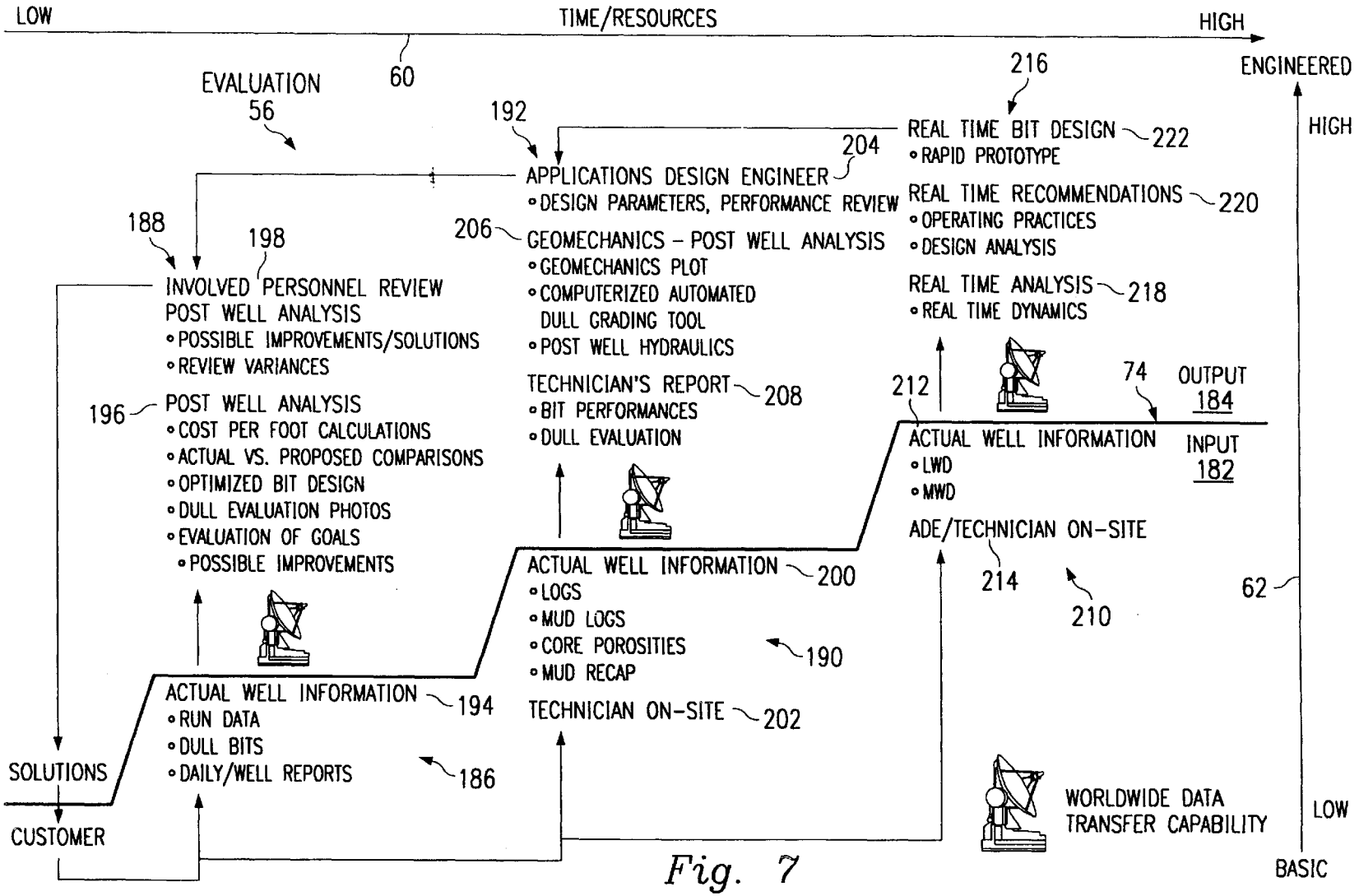
FIG. 7 illustrates an embodiment of the evaluation phase of the method for engineering a drilling bit program according to the present disclosure.

Referring to the FIGS. 4–8, a scale is provided along both the top and side of each FIG. The scale 60 at the top denotes time/resource required and increases from left to right. The scale 62 on the side represents the quality or comprehensiveness of the service (or input and output) and increases from bottom to top. The scale 62 of service quality or comprehensiveness ranges from 'basic' to 'engineered'. In particular, FIG. 4 illustrates a cascaded nature of each phase of the present method and apparatus for the engineering of a drilling bit program in terms of various levels. The various levels are a function of time and resource 60 required for achieving a desired quality solution or comprehensiveness of service 62, with time and resource 60 ranging from low to high and a corresponding solution and/or service for the engineered drilling program having a solution or service 62 ranging from basic to engineered.

A drilling bit program generated from a minimal amount of input obtained from the customer will require less time and resource to generate a 'basic' or level 1 type of engineered bit solution. The minimal amount of input dictates that the output would stay in the lower level 'loop' to generate a basic recommendation (i.e., engineered solution) back to the customer. However, if a project or drilling program is more involved and a comprehensive or 'engineered' program is needed to be developed, then it is necessary to have additional input from the customer. As shown in FIG. 4, the higher the output level, the more information or input is required and the more time and resource 60 is needed to develop the proper engineered solutions. Thus, a most comprehensive output requires input from all possible levels, the most comprehensive output including output from all levels returning (i.e., cascading) back to the customer in the form of solutions. Therefore, to the degree that a customer provides all available information and input, then the comprehensive output becomes more highly engineered and the loop becomes much larger, for example, extending from the first level 64, second level 66, and up to a level three 68 or above (i.e., a third or fourth level).

In accordance with the method of the present disclosure, engineering a drilling bit program which is linked to rock removal at a cutting element/formation interface 12 and specific to drilling of one or more wells 14 in a given geographic area 16 includes the steps of planning 52 the drilling of a particular well and providing an engineered output (FIG. 5), implementing 54 the engineered output (FIG. 6), and evaluating 56 the implementation (FIG. 7). In particular, planning 52 the drilling of a particular well is based upon a cascaded planning input 70 (70*a*,70*b*). The planning step further includes providing an engineered output 72 which is a function of the cascaded planning input 70. The level of the engineered output 72 is dependent upon a level of the cascaded planning input 70. In a second step, the engineered output 72 is implemented in the drilling of the particular well via the implementation phase 54. Lastly, the implementation of the engineered output 72 for the drilling of the particular well is evaluated and an evaluation output 74 provided via the evaluation phase 56. The evaluation output can be used in the planning phase 52 as additional planning input for planning the drilling of a subsequent well in the geographic area.

Referring now to FIG. 5, in one embodiment, the cascaded planning input 70 (70*a*,70*b*) includes at least two levels of input (76,78). A first level 76 of planning input 70 is characterized by a first amount of time and resource 60 for providing a first level of engineered output 77. A second level 78 of planning input is characterized by a second amount of time and resource 60 for providing a second level of engineered output 79. As the second level of planning input is a more comprehensive input than that of the first level, the second amount of time and resource is greater than the first amount of time and resource. For the cascaded input 70, the second level of planning input 78 includes the first level of planning input 76.

Referring still to FIG. 5, the planning phase 52 is further illustrated as including four (4) cascaded levels. A first level 76 of planning phase 52 includes a minimum of time/resources input and a basic engineered output. The input includes customer input 70*a* and service provider input 70*b*. The customer input 70*a* for the first level 76 preferably includes well information 80. The well information further includes such input as well location, depth, hole sizes, casing program, formation tops (lithologies), and offset well data/bit records. The first level 76 further includes input 70*b* from the service provider. The service provider input 70*b* for the first level is at a minimum of time/resources and can include local knowledge/experience 82, offset bit run data 84, previous post well analysis 86 (as available), and a bit record database 88. With respect to the bit record database 88, the database includes bit records and field run reports (FRR's), bit types/performances, and dull bit grades. Field run reports include engineer or test bit reports of test bits. As shown in FIG. 5, the engineered output 77 for the first level 76 includes a bit recommendation 90. The bit recommendation 90 may include bit size, bit type, bit operating parameters, cost estimates, bit/lithology prognosis, and set goals.

Referring still to FIG. 5, a second level 78 of the cascaded planning input 70 includes the first level of input and additional customer input 70*a* and service provider input 70*b*. The additional customer input 70*a* for the second level 78 preferably includes drilling/well reports 92, rig specifications 94, and mud program information 96. The drilling/well reports 92 can include hazards, performance, and formation characteristics. The rig specifications 94 can include pump data, drill pipe, drill collar, bottom hole assembly (BHA), downhole tool specifications, rig rate, rig crew capabilities, and directional details. Lastly, the mud program 96 can include identification of drilling fluid type and properties. The additional service provider input 70*b* for the second level 78 preferably includes economics 98, hydraulics 100, and bit design 102. Economics 98 can include a computerized well cost. The hydraulics 100 can include computerized hydraulics. Lastly, the bit design 102 can include the use of design at the customer interface tool and the availability of an applications design engineer. As shown in FIG. 5, the additional engineered output 79 for the second level 78 includes a bit recommendation/program 104. The bit recommendation/program 104 includes hydraulics, economics/break-even, specific operations considerations, and a cost savings analysis. The engineered bit program for the level two planning includes the second level engineered output 79 and the first level engineered output 77.

A third level 106 of the cascaded planning input includes the first two levels of input and additional customer input 70*a* and service provider input 70*b*. The additional customer input for the third level 106 preferably includes a directional plan 108 and logs 110. The directional plan 108 includes well profile, type of drive system and processes and techniques. The logs 110 include any lithology sensitive log suite, mud logs, core porosities, and a caliper log. The additional service provider input 70*b* corresponding to the third level 106 includes bit design 112, detailed performance analysis 114, and GeoMechanics™ drilling analysis 116. The bit design 112 can include the use of design at the customer interface tool (DatCI) and the availability of an applications design engineer (ADE). The detailed performance analysis 114 can include information from a bit performance database and bit performance reviews. Lastly, the GeoMechanics™ drilling analysis 116 can include information on rock strength and bit design feature selection. As shown in FIG. 5, the additional engineered output 118 for the third level 106 includes a detailed program 120. The detailed program 120 includes GeoMechanicsm drilling analysis plots, bit performance analysis, and specific design features. The engineered bit program for the level three planning includes the third level engineered output 118 and the first and second level engineered outputs (77,79).

A fourth level 122 of the cascaded planning input includes the first three levels of input and additional customer input 70*a* and service provider input 70*b*. The additional customer input 70*a* for the fourth level 122 preferably includes drilling dynamics 124, formation samples 126, and surface/structural maps 128. The drilling dynamics 124 includes downhole vibration data. The formation samples 126 include cores/cutting samples. Lastly, the surface/structural maps 128 include well and offset location information, and stratigraphic cross section information. The additional service provider input 70*b* for the fourth level 122 includes bit design 130, formation analysis report 132, PROBE 134 and GeoMechanics™ drilling analysis 136. The bit design 130 can include the use of design at the customer interface tool (DatCI) and the availability of an applications design engineer (ADE). The formation analysis report 132 can include SEM photos and x-ray diffraction analysis. The PROBE input 134 can include an interval based detailed bit performance analysis. Lastly, the GeoMechanics™ drilling analysis 136 can include mechanical efficiency/work rating, recommended operating parameters, wear rate prediction, performance prediction, and design enhancements. As shown in FIG. 5, the additional engineered output 138 for the fourth level 122 includes an engineered program 140. The engineered program 140 includes surface stratigraphic maps, GeoMechanicsTM drilling analysis plots, formations analysis report, detailed offset performance reports, and downhole dynamics recommendations (including bit and BHA) The engineered bit program for the level four planning is cascaded and includes the fourth level engineered output 138 and the first, second and third level engineered outputs (77,79,118). The engineered bit program for the level four planning thus provides a maximum engineered output.

As shown in FIG. 5, the cascaded planning input 70 can thus range from a minimum level of planning input to a maximum level planning input. As the level of the engineered output 72 is dependent upon a level of the cascaded planning input 70, the engineered output can thus vary from a basic engineered output to a highly engineered output in response to the respective cascaded planning input. In addition, the engineered output can further include a cascaded output. That is, the cascaded output includes outputs in response to each successive level of planning input. For a prescribed level of engineered output, there is a cascaded input corresponding to all cascaded input levels up to a given level of planning input corresponding to the prescribed level of engineered output.

Referring now to FIG. 6, with respect to implementation 54, the implementing step includes a cascaded implementation based upon a cascaded implementation input 142. A cascaded implementation output 144 is provided which is a function of the cascaded implementation input 142. Furthermore, a level of the cascaded implementation output 144 is dependent upon a level of the cascaded implementation input 142.

In one embodiment, the cascaded implementation input includes at least two levels. A first level 146 of implementation input 142 is characterized by a first amount of time and resource 60 for providing a first level of implementation output 148. A second level 150 of implementation input 142 is characterized by a second amount of time and resource 60 for providing a second level of implementation output 152. As the second level of implementation input is a more comprehensive input than that of the first level, the second amount of time and resource is greater than the first amount of time and resource for implementing the engineered output during the drilling of the particular well. In conjunction with the cascaded implementation input, the second level 150 of implementation input includes the first level 146 of implementation input.

Referring still to FIG. 6, the implementing phase is further illustrated as including three (3) cascaded levels. A first level 146 of the implementing phase 54 includes a minimum of time/resources input and a basic implementation output. The customer input 142 for the first level 146 preferably includes a customer implementation 154 of the engineered bit program, including providing access to run data, on bits being run, for an applications engineer of the service provider. In addition, for the first level 146, the customer may also request assistance of an applications engineer from the service provider 156. As shown in FIG. 6, the implementation output 148 for the first level 146 includes off-site technical support 158, including product service/delivery. The off-site technical support 158 (or remote support) may include providing an applications engineer 160 and product service/delivery 162. During this first level of implementation, the applications engineer 160 can review/evaluate the bit program, review any post well analysis, and review/evaluate the well progress.

A second level 150 of the cascaded implementing input includes the first level of input and additional customer input 142. For the second level 150, the customer may request on-site technical assistance 164 from the service provider. As shown in FIG. 6, the additional implementation output for the second level 152 includes on-site technical support 166. The on-site technical support 166 may include providing an applications engineer 168 and a technician 170 assigned to the particular project. The applications engineer provides for implementing program recommendations, performing an economics/break even analysis, and is available to monitor/adjust parameters. In addition, the applications engineer and/or technician are available at the rig site and can provide on-site bit reports. The engineered bit program for the level two implementation includes the second level implementation output 152 and the first level implementation output 148.

A third level 172 of the cascaded implementing input includes the first two levels of input and additional customer input 142. For the third level 172, the customer may request in-house assistance 174, including providing daily access to bit run data for use by the in-house assistant (ADE or TA) of the service provider. For example, daily access preferably includes access to daily reports, including all run data on the bits being run. Such daily access speeds the transfer of needed information to the ADE or TA for use in generating output in the engineering of the drilling bit program. As shown in FIG. 6, the additional implementation output 176 for the third level 172 includes in-house, more highly comprehensive, technical support 178. The in-house technical support includes providing an applications engineer (ADE) and/or technician (TA) in-house. The in-house technical support further includes in-house design capability, daily performance monitoring, daily report maintenance, logistics, and any other needed in-house technical support. In addition, the applications engineer and/or technician 180 may be placed at the rig site as may be required. The engineered bit program for the level three implementing is cascaded and includes the third level implementing output 176 and the first and second level implementing outputs (148,152). The engineered bit program for the level three implementing thus provides a maximum implemented output.

As shown in FIG. 6, the cascaded implementation input 142 can range from a minimum level of implementation input to a maximum level implementation input. As the level of the implementation output 144 is dependent upon a level of the cascaded implementation input 142, the implementation output 144 for implementing the engineered output during the drilling of the particular well can thus vary from a basic implementation output to a highly engineered implementation output in response to the respective cascaded implementation input. In addition, the implementation output can further include a cascaded output. That is, the cascaded output includes outputs in response to each successive level of implementation input. For a prescribed level of engineered implementation output, there is a cascaded input corresponding to all cascaded input levels up to a given level of implementation input corresponding to the prescribed level of engineered implementation output.

Referring now to FIG. 7, with respect to evaluation 56, the evaluating step includes a cascaded evaluation based upon a cascaded evaluation input 182. A cascaded evaluation output is provided which is a function of the cascaded evaluation input 182. Furthermore, a level of the cascaded evaluation output 184 is dependent upon a level of the cascaded evaluation input 182.

In one embodiment, the cascaded evaluation input includes at least two levels. A first level 186 of evaluation input is characterized by a first amount of time and resource 60 for providing a first level of evaluation output 188. A second level 190 of evaluation input is characterized by a second amount of time and resource 60 for providing a second level of evaluation output 192. As the second level of evaluation input is more comprehensive than the first level of evaluation input, the second amount of time and resource is greater than the first amount of time and resource. In conjunction with the cascaded evaluation input, the second level of evaluation input includes the first level of evaluation input.

Referring still to FIG. 7, the evaluation phase is further illustrated as including three (3) cascaded levels. A first level 186 of the evaluation phase 56 includes a minimum of time/resources input and a basic evaluation output. The customer input 182 for the first level 186 preferably includes actual well information 194. Actual well information 194 includes run data, dull bits, and daily well reports. As shown in FIG. 7, the evaluation output 188 for the first level 186 includes a post well analysis 196 and a review of the post well analysis 198 by involved personnel. During this first level of evaluation, the post well analysis 196 may include cost per foot calculations, actual vs. proposed comparisons, optimized bit designs, dull evaluation photos, and evaluation of goals, further to include possible improvements. The review of the post well analysis 198 by involved personnel may include generation of possible improvements/solutions and a review of variances.

A second level 190 of the cascaded evaluation input includes the first level of input and additional customer input 182. For the second level 190, the customer input includes additional actual well information 200 and may request on-site technical assistance 202 from the service provider, wherein the on-site technical assistant would generate information on-site for use in the evaluation. The actual well information 200 further includes electric and nuclear logs, mud logs, core porosities, and mud recap. Mud recap includes a daily report of mud properties being run, wherein the properties of the mud affect drill bit performance. As shown in FIG. 7, the additional evaluation output 192 for the second level 190 includes availability of an applications design engineer (ADE) 204, GeoMechanics™ post well drilling analysis 206, and a technician's report 208. The applications design engineer 204 provides a design parameters and performance review. The GeoMechanics™ post well drilling analysis 206 includes a post well analysis plot, a computerized automated dull grading tool, and post well hydraulics. The technician's report 208 includes bit performances and dull evaluation. The engineered bit program for the level two evaluation thus includes the second level evaluation output and the first level evaluation output.

A third level 210 of the cascaded evaluation input includes the first two levels of input and additional customer input 182. For the third level 210, the customer input includes additional actual well information 212 and may request on-site ADE/TA assistance 214 from the service provider, wherein the on-site ADE/TA would generate information and bit solutions on-site for use in the evaluation and evaluation output. The actual well information 212 further includes lithology while drilling (LWD) and measurement while drilling (MWD) information. As shown in FIG. 7, the additional evaluation output 216 for the third level 210 includes real time analysis 218, real time recommendations 220, and real time bit design 222. The real time analysis 218 includes real time dynamics. The real time recommendations 220 include operating practices and design analysis. Lastly, the real time bit design 222 includes rapid prototyping. The engineered bit program for the level three evaluation is cascaded and includes the third level evaluation output 216 and the first and second level evaluation outputs (188,192). The engineered bit program for the level three evaluation thus provides a maximum evaluation output.

As shown in FIG. 7, the cascaded evaluation input 182 can range from a minimum level of evaluation input to a maximum level evaluation input. As the level of the evaluation output 184 is dependent upon a level of the cascaded evaluation input 182, the evaluation output 184 can thus vary from a basic evaluation output to a highly engineered evaluation output in response to the respective cascaded evaluation input. In addition, the evaluation output can further include a cascaded output. That is, the cascaded output includes outputs in response to each successive level of evaluation input. For a prescribed level of engineered evaluation output, there is a cascaded input corresponding to all cascaded input levels up to a given level of evaluation input corresponding to the prescribed level of engineered evaluation output.

In accordance with another embodiment of the present disclosure, a system 10 is provided for carrying out the method as outlined herein (FIG. 1). In particular, the system 10 for engineering a drilling bit program linked to rock removal at a cutting element/formation interface 12 and specific to drilling of one or more wells 14 in a given geographic area 16 includes a means for planning a bit program for the drilling of a particular well, a means for implementing the planned bit program, and a means for evaluating the implemented bit program. The planning, implementation, and evaluation means include suitable tools, mechanisms, apparatus, and/or personnel for carrying out the method in accordance with the present disclosure, further as discussed herein above. The planning means is provided for planning the drilling of a particular well based upon a cascaded planning input. The planning means further provides an engineered output which is a function of the cascaded planning input. A level of the engineered output is dependent upon a level of the cascaded planning input. The implementation means is provided for implementing the engineered output in the drilling of the particular well. Lastly, the evaluation means is provided for evaluating the implementation of the engineered output for the drilling of the particular well. The evaluation means further provides an evaluation output, wherein the evaluation output can be used by the planning means as additional planning input for planning the drilling of a subsequent well in the geographic area.

In one embodiment, the cascaded planning input includes at least two levels. A first level of planning input is characterized by a first amount of time and resource for providing a first level of engineered output. A second level of planning input is characterized by a second amount of time and resource for providing a second level of engineered output. As the second level of planning input is more comprehensive than the first level of planning input, the second amount of time and resource is greater than the first amount of time and resource. For the cascaded input, the second level of planning input includes the first level of planning input. In addition, the engineered output can vary from a basic engineered output to a highly engineered 5 output in response to a planning input range from a minimum level of planning input to a maximum level of planning input of the cascaded planning input. The engineered output can further include a cascaded output, wherein a prescribed cascaded output includes outputs in response to each successive level of planning input, up to a given level of planning input corresponding to the prescribed level of engineered output.

The implementation means includes a means for performing a cascaded implementation in the drilling of the particular well based upon a cascaded implementation input. The implementation means further provides a cascaded implementation output which is a function of the cascaded implementation input. In addition, a level of the cascaded implementation output is dependent upon a level of the cascaded implementation input.

In one embodiment, the cascaded implementation input further includes at least two levels, a first level of implementation input characterized by a first amount of time and resource for providing a first level of implementation output and a second level of implementation input characterized by a second amount of time and resource for providing a second level of implementation output. As the second level of implementation input is more comprehensive than the first level of implementation input, the second amount of time and resource is greater than the first amount of time and resource for implementing the engineered output during the drilling of the particular well. Still further, the second level of implementation input includes the first level of implementation input. With reference to FIG. 6, the implementation output can vary from a basic implementation output to a highly engineered implementation output in response to an implementation input range from a minimum level of implementation input to a maximum level of implementation input of the cascaded implementation input. In addition, the implementation output further includes a cascaded output. A prescribed cascaded output includes outputs in response to each successive level of implementation input up to a given level of implementation input corresponding to the prescribed level of the implementation output.

The evaluating means includes a means for performing a cascaded evaluation based upon a cascaded evaluation input. The evaluation means further provides a cascaded evaluation output which is a function of the cascaded evaluation input. A level of the cascaded evaluation output is dependent upon a level of the cascaded evaluation input. In one embodiment, the cascaded evaluation input includes at least two levels, a first level of evaluation input characterized by a first amount of time and resource for providing a first level of evaluation output, and a second level of evaluation input characterized by a second amount of time and resource for providing a second level of evaluation output, wherein the second amount of time and resource is greater than the first amount of time and resource. The second level of evaluation input includes the first level of evaluation input. With reference again to FIG. 7, the evaluation output can vary from a basic evaluation output to a highly engineered evaluation output in response to an evaluation input range from a minimum level of evaluation input to a maximum level of evaluation input of the cascaded evaluation input. The evaluation output further includes a cascaded output, wherein a prescribed cascaded output includes outputs in response to each successive level of evaluation input, up to a given level of evaluation input corresponding to the prescribed level of evaluation output.

It is important to note that planning, implementation, and evaluation each contain specific levels of service (i.e., engineered output) particular to the respective phase. For example, on the planning CASCADE of FIG. 5, there are currently four (4) levels of service or engineered output increasing in technical content from left to right and from bottom to top. In addition, CASCADE can be more flexible than that as illustrated with the various levels. That is, instead of the various levels, the dividing line between input and output can include a straight line, wherein the straight line denotes an always increasing and continuously improving cascaded engineered output based upon the quality of the cascaded input data, in addition to the solution provider's relationship with the customer. However, for clarity, the various levels of service are cascaded as shown in the FIGS. 5–7.

Referring again to FIG. 5, CASCADE 50 includes the planning phase 52 as the initial phase of the CASCADE process. In the planning phase, knowledge, service capabilities and technical tools of the solutions provider are used to analyze information which is available, including information from the customer and also the solutions provider. A goal of the solutions provider is to provide the customer the benefits of the solutions provider's capabilities and the quality and effectiveness of the provider's solutions. The method of providing solutions is through the engineered output from CASCADE. In the planning phase, this engineered output takes the form of a bit recommendation or an engineered bit program. The bit program can include a written recommendation to the customer concerning the tools and procedure for drilling a section of hole, a complete well, or a series of wells. During the planning phase, all available relevant information is gathered and analyzed in order to produce a detailed technical proposal. At its most basic level, and dependent upon the quality and quantity of information provided by the customer, the proposal may typically include engineered solutions selected from the following: a) quantity and types of bits recommended; b) drilling time and rate of penetration (ROP) estimates; c) bit operating parameters; and d) bit and drilling cost calculations. At a more technical level, the proposal may also include additional solutions selected from the following: a) hydraulics and economics recommendations; b) ADE design development;

c) GeoMechanics™ drilling analysis system analysis; and d) detailed offset performance analysis. At a highest planning level, for an extremely detailed 'engineered' solution, all of the above mentioned solutions are included in addition to solutions selected from the following: a) a detailed foot-based performance analysis (PROBE); b) X-ray diffraction and SEM formation analysis; c) mapping of formation tops within a specific area; and d) comprehensive database analysis and design performance review of an offset area. While in general the level of service is a function of the customer's input and/or requests, the final decision to allocate resources is also based on a financial and risk/reward analysis. For instance, the solutions provider may decide independently to provide a drilling technician (DT) to be available for a bit run in order to gain detailed run data and a better knowledge of the particular drilling application, and hence, shorten a learning curve with respect to the particular well and/or field. As a result, an engineered bit solution may be obtained in an even further reduced amount of time.

Referring now to FIG. 6, the implementation phase 54 of CASCADE includes the following. Recommendations concerning implementation of a bit proposal should be formulated in conjunction with the planning phase 52. For example, a basic level bit program might simply be implemented by the customer with the solutions provider being available for consultation. However, the higher level 'engineered' program may require that a drilling technician (DT) be present at the rig in order to implement the run recommendations, monitor/adjust parameters, measure economics, and compile an on-site technician's report. At the highest level, the solutions provider would place an in-house representative within the customer's office. The later instance would allow the solutions provider to become directly involved in the customer's decision-making process or even assume a portion of that process. Other personnel involved at the higher level besides the in-house representative may include an application design engineer (ADE), technical analyst (TA), or a logistics coordinator (LC).

Turning now to FIG. 7, the evaluation phase 56 of CASCADE closes the loop. Within CASCADE, closing the information loop allows the solutions provider to evaluate performance and continue evolving solutions yet to be provided. The customer will also be interested in the post well analysis because of recognizing the importance of applying 'lessons learned' to a next upcoming well. As a result, it is extremely important for the evaluation phase to be completed, lessons learned noted, recommendations for the future specified, and possible design/operating practice changes examined for the next well. The evaluation phase 56 is also important because it provides an evaluation of product performance. The evaluation of product performance advantageously leads to design improvements. Design improvements furthermore advantageously leads to innovation for achieving a desired engineered bit program and for bringing an oil producing well on-line in a reduced amount of time, not otherwise achievable.

Continued development of real time tools, such as measurement while drilling (MWD), lithology while drilling (LWD), and instrumented bits, increase the solutions provider's capability to do real time performance analysis. For example, instrumented bits would allow for on-site parameter adjustment to eliminate or correct improper bottom hole dynamics and improve bit performance. Real time GeoMechanics™ drilling analysis may allow the solutions provider to determine bit/formation interactions during an actual drilling procedure. All of the tools mentioned herein would enable an on-site drilling technician (DT) more knowledge and control of actual bottom hole conditions allowing the DT to respond quickly to formation changes and other dynamic conditions. It is thus contemplated that all phases of the CASCADE process, including planning for a immediately subsequent run, will take on a more real time nature.

The discussion will now be briefly directed to a local organization of a solutions provider, further relating to the CASCADE process. As discussed, the CASCADE process requires multiple levels of service capabilities and technical expertise. When a customer is initially contacted, it is important for each area or local organization of the solutions provider to be aware of the solutions provider's capabilities. If a customer expects a highly engineered bit program, then it is necessary for each particular area or local organization of the solutions provider to have the skill and expertise available to generate a required high level of output. For example, not only are planning skills required for the planning phase, but from the implementation side or phase, a skilled drilling technician (DT) will be needed to be present on the customer's rig to ensure that the engineered bit plan is properly implemented.

Each area or local organization of the service provider preferably reviews all CASCADE phases with respect to skills and resources required for each. Once an area or local organization of the service provider is aware of the highest levels that the local organization can achieve within each phase of the CASCADE process, then it is a simple matter to allocate resources and assign responsibilities. If it is discovered that additional skill sets are required, then the extra skill sets must be obtained from outside the area or local organization.

Various personnel for taking on a given responsibility, as outline within the CASCADE process, include the following. A first function includes asset manager. An asset manager would be provided to lead a team for implementing the CASCADE process, the asset manager for deciding upon the assets and level of resources to be deployed to fulfill a particular task in the CASCADE process and to satisfy the customer's needs. Formation of teams with expert level competencies (as opposed to a generalist) may be required locally to ensure customer satisfaction during an introduction to the CASCADE process and as additional tools are developed and introduced. Another function includes technical analyst. A technical analyst (TA) is responsible for completing the data analysis package at a required level. An increasing level of competency mirrors the increasing provision of service in the four levels depicted in the planning phase of the CASCADE process. Another function is applications design engineer. The role of the application design engineer (ADE) is to continue providing solutions through application and design, and with an increased focus and development on the role of the customer interface. The ADE and TA functions will become more cooperative and interdependent with the increasing level of service provided. Still another function is drilling technician. The drilling technician (DT), having an awareness of the performance expectation, ensures that full advantage is taken of the opportunity afforded by higher levels of service provided. The DT functions as a data entry and analysis point at the rig site, and is involved with the TA and ADE in the post well analysis.

The following is an example of how an area organization of the service provider may handle the distribution of responsibilities associated with the CASCADE process. The method of formulating an area-wide team can prove very effective in ensuring that the skill sets and personnel required to meet the service needs are present within the given area. The three phases of the CASCADE process further include a listing of personnel along with the job functions and specific job activities. The example below further illustrates how distribution of responsibilities ensures that all members of the team are aware of their respective direct responsibilities and who will be preforming which task.

As stated previously herein, as a function of the higher level of the CASCADE process, it is important to place a service provider representative in the customer's office whenever possible. The benefits of doing so become more and more evident in transitioning to a service-based and knowledge-based company. Having a service provider representative in the customer's office enables the representative to become a participating member of the drilling team. As such, the service provider comes closer to the actual decision making process. In certain instances, the representative may become actively responsible for decision making associated with the drilling of a well for the customer.

With the use of an in-house representative, it becomes possible to decrease the amount of time required to process the information which becomes now more readily available. For example, in the past, an outside account manager would have to schedule appointments with the various project engineers and drilling personnel of the customer in order to obtain the required information about an upcoming well. Many times, appointments would have to be rescheduled and/or information would be unavailable. All of the movement back and forth between the customer's office and the service provider's office undesirably consumes time. However, with a representative placed in the customer's office, obtaining information about current or upcoming wells is less of a problem because an integral part of the representative's job is to handle the reporting of information, making daily reports about performances, consulting on a daily basis with the customer's drilling engineers, and completing the post well analyses on finished projects. The result is that the information which was previously so difficult to obtain is now a part of the daily responsibilities of the in-house representative. Planning, implementation, and evaluation becomes much easier due to an availability of information. The quantity of information can then be appropriately addressed by ensuring that the representative has the appropriate skills or tools available to handle the technical requirements placed upon the respective in-house position. It is contemplated that further success of the in-house representative and the higher CASCADE levels will result with the development of newer, better, and easier to use drilling analysis tools.

As discussed herein above, tools for use in the CASCADE process include DatCI, GeoMechanics™ drilling analysis system, a product performance database system (PPDS), and PLANIT. The tools assist in quickly developing both a basic engineered bit program or a highly engineered bit program. Development of additional tools is also contemplated for the CASCADE process, which include developing a set of baseline tools to be utilized within the CASCADE process for further improving drilling efficiencies for a customer. The additional tools are preferably linked together (i.e., to as many of each other as possible) so that manual data input is kept to a minimum, yet the ability to manipulate the performance data with a variety of tools is at a maximum. With the linking of the additional tools to existing tools, such as GeoMechanics™ drilling analysis system and PPDS, the linking will further assist in the development of engineered drilling bit programs, analysis of bit performance, and the creating of detailed post well analyses with a minimum of required computer know-how. In addition, the linking of the additional tools will further provide for an elimination of the requirement of continually re-entering of the same data into each of the different tools to obtain a specific output of a respective tool. Additional tools may include, for example, a qualifying form tool, a bit program tool (i.e., for use in the planning phase of CASCADE), a hydraulics tool (e.g., a program within PLANIT with appropriate modification), an economics tool (such as a cost-per-foot and break-even analysis tool), an integrated output of products and services tool, a technician's report tool, a bit performance analysis tool, a bit design review report rendering tool, a technical materials tool, a marketing materials tool, a post well evaluation tool, a post run evaluation rendering tool, an interval based performance analysis system tool, an economics/risk analysis tool, and a hydraulics analysis tool. The tools mentioned herein are contemplated to be utilized for supporting the CASCADE process.

The present well programming process method and apparatus are characterized as a process and apparatus for advantageously obtaining engineered bit solutions relating to well programming in the rock formation drilling industry. In other words, the method and system apparatus of the present disclosure advantageously provide for engineering a drilling bit program specific to the drilling of one or more wells in a given geographic area.

The present method and apparatus defines, qualifies and quantifies various cascaded levels of input and output as described herein. A drilling service provider can use the various cascaded levels as a guide to transition itself from a product oriented company to a service and knowledge based company. Due to the evolving nature of the drilling/oil field service industry, drilling operators are becoming more and more dependent upon the technology, knowledge and experience held by a service company. As a result, a successful service based company will not only provide good products, but will also provide the service and knowledge that is being demanded more and more by the customer. In order to assist in developing a capability and capacity within the drilling service based company, the present method and system apparatus advantageously define and provide a quantifiable approach for engineering of a drilling bit program through three distinct phases. The three phases include planning, implementation, and evaluation. The method and apparatus includes mapping out the three phases with respect to a given resource/time required and quality of output (i.e., the engineered bit solution) that results for the respective resource/time which is input. The method and apparatus further includes and defines how an end user or customer is integrated into the particular engineered bit programming process, in addition to what type (types) of information is (are) required from the end user. As a result, the end user or customer becomes an integral part in the development of engineered bit solutions tailored to the end user's particular well program. In addition, the present method and apparatus defines and includes various levels of service, tools, and/or service provider knowledge/resources which can be made available to a customer depending upon the nature of a particular well drilling project and an amount of input information.

The present method and apparatus further advantageously focuses a service provider's attention to be placed on a customer's specific application(s) and/or problem(s) in order to develop quality engineered bit solutions suited for that specific application or problem alone. The present embodiments differ greatly from past methods, where a bit manufacturer would develop a very wide product line in hopes that a customer would then select one of the products and apply the product themselves (i.e., the customer). In contrast, the present method and apparatus for engineering a drilling bit program focuses on the customer, the customer's specific problem, and are used to develop a built-for-purpose engineered bit solution for the customer's particular situation and/or problem. The present method and apparatus further includes not only the development of an engineered bit solution, but also the implementation or application of the engineered bit solution, and still further, an analysis and evaluation of the results of the implementation or application. It is important to note that the present method and apparatus does not require a recommending of products built solely by a particular company, but rather involves the selection, recommendation, and application of a correct solution and product, no matter who is the manufacturer of a particular product.

The present method may also serve as a guide to develop both capacity and capability within an organization due to the quantifiable and qualifiable nature of the present method. That is, the present method can be used by the service provider as a guide to evaluate the service and knowledge capability of various parts of its organization, whereby the service provider can then act to improve itself through an alignment with the processes defined herein. For example, if a particular group within the service provider organization can not furnish a level three (3) service, then with the use of the method of the present disclosure as a guide, appropriate improvements can be made. Improvements may include, for example, identifying what personnel characteristics or capabilities are required and what results will possibly be achieved if the improvements are made. Also, the present method can serve as a guide to define a training program within the service provider organization to further develop the service provider's technical or high level capacity and capability for the engineering of a drilling bit program.

In a further discussion of the above, the present method, in part, defines actions in terms of service and knowledge (input information) capacity and capability. In addition, a manufactured product, such as a drilling bit, plays an important part in the engineering of a drilling bit program, however, the manufactured product is not the driving force over and above furnishing service or application knowledge (input information). The manufactured product is simply one part of the solution or engineered output, along with service and application knowledge (input information).

The present method may also serve as a guide for defining how a drilling services company can become more effective in providing drilling bit solutions to a customer, providing service and knowledge (input information) through the use and development of specific tools as discussed herein with respect to FIGS. 5–7. The method is further improved and can become even more effective through providing of qualified in-house representation at or near a customer site or the geographic area of the drilling operation for which the engineered drilling bit program is being generated and carried out.

With the method and system apparatus of the present disclosure, development of purpose built solutions, through rock bit design at the customer interface or with competitor products and the provision of service and knowledge (input information) via a defined process, are now available. The present method follows a total quality management principle of focusing solely on the needs of the customer and provides for an organization which supports the process of developing the correct bit solution for the customer. Not only can the present method be of benefit to the major drilling operators world wide, but the service and knowledge capabilities of an organization formed in line with the present method and apparatus would also be of value to the smallest of drilling operators and contractors. In other words, an organization formed around the present method would be focused on providing the proper solutions to all customers no matter what the customers' size.

Mapping of the engineered bit program process of the present disclosure will now be discussed. The method and system apparatus of the present disclosure take into account that within a single drilling service provider company, there may exist some planning/programming inconsistencies needing to be addressed. In order to improve a given situation, the method of the present disclosure defines and maps recommended bit programming processes. The resulting defined, or mapped, bit planning/programming process can be advantageously utilized, for example, in answering a drilling operator's questions, in addition to assisting with a training program development for the drilling service provider. In addition, such a mapping helps to ensure that a bit planning/programming process is kept consistent and standardized throughout the drilling service provider company. A key factor in the mapping of the engineered bit program process is ensuring that the process is well defined and well documented from the beginning. Appropriate personnel having bit planning/programming experience and computer skills within the drilling service provider company can be assembled, as necessary. A map of the processes involved in the engineered bit program for a service provider can then be readily created.

In further discussion of the process involved in the creation of an engineered bit program, an engineered bit program includes a final presentation, quality output in response to certain well planning input information. In the final presentation, quality output is generated by a team of personnel having well programming experience, the team being referred to hereafter as the strike team. The output is preferably a highly engineered bit program which analyzes all relevant factors involved in a very detail oriented, technical proposal to a customer or drilling operator. The engineered bit program includes such detailed analyses as: formation top locations and stratigraphy throughout a particular field to be drilled and mapping of the same; analysis of geologic literature pertaining to the particular field from any available sources (for example, universities, geological databases, etc.); a GeoMechanics™ drilling analysis of the required area; laboratory analysis of cuttings/formation samples taken from the particular field using scanning electron microscope and x-ray diffraction tools; and comprehensive bit record analysis and performance review for the particular geographic area. Equipped with the analyses or studies, the engineered bit program includes a review of all findings. The findings or results are then utilized to make a series of product design and applications recommendations to the particular customer or drilling operator.

The method and system apparatus for engineering a bit program of the present disclosure includes a strike team project or module. The strike team project (or module) includes a multi-disciplined approach to the development of an effective and repeatable bit programming system and process of a particular drilling program. The bit programming system and process can include, for example, a design at the customer interface (DatCI) of a rock bit at an area level, the area level corresponding to a geographic area of the field to be drilled as part of the drilling program. Key aspects of the bit programming system and process are that it is multi-disciplined, effective and repeatable. A multi-disciplined approach includes one in which a wide variety of personnel participate and wherein the personnel make every effort to effectively contribute to the success of the strike team. Because a bit programming system and process can and will involve the expenditure of considerable time and effort, a proven bit programming system and process will make those expenditures worthwhile. Also, the bit programming system and process must be repeatable. Similar projects in various different areas or with other customers will likely arise. Thus, having a bit programming system and process which is well defined and a team that is well-trained in the particular system requirements, then repeatability will not be a problem.

A goal for the strike team project or module is to obtain a prescribed amount of input information and to gain in knowledge. The more input information and knowledge which is gained through the strike team project or module, then the more effective and powerful the method of the present disclosure will be in providing an optimal engineered bit program to a particular customer or drilling operator. With an involvement of area personnel, support personnel, management and customer personnel within the process of the strike team project ensures that knowledge is gained and transferred in a most effective manner. The overall results of the strike team project effort will be the involvement of area personnel in the design at the customer interface (or DatCI) process, involvement of support personnel and their expertise at the area level, an effective presentation of the service provider's capabilities to a customer, and finally, the successful achievement of product development goals. Successful strike team projects lead to further customer participation and increased confidence by the customer in a service provider's capabilities.

In the engineered bit program of the method and system apparatus of the present disclosure, formation/cuttings sample analysis is also preferably included and used, as discussed below. With respect to the formation/cuttings sample analysis, customer involvement at an early stage of the engineered bit program is required to ensure that samples taken from the field of interest are available. Customer involvement also includes the providing of samples according to a given set of requirements as appropriate for a given formation/cuttings sample analysis. Analysis tools include scanning electron microscope (SEM) and x-ray diffraction tools, for example, and are readily known in the art. The analysis tools can be used to provide qualitative information about the particular samples. If there is little for one to learn about a given formation, then a sample study will not be helpful and a lot of effort can disadvantageously be spent with little gain. However, a sample analysis can be useful for trying to understand and identify a matrix material involved in a particular formation. For example, it may be desirable to understand and identify the matrix material involved in sandstones of a particular field of interest.

In the engineered bit program, a geological map system can also be included. The geological map system preferably includes large, detailed maps. The large, detailed maps can be utilized to plot formation tops and rock bit performances in specific areas. The advantageous result is that rock bit performance trends by area can be easily recognized and target areas can be readily defined.

The engineered bit program further includes use of detailed geological studies which may be available from universities or other sources proximate to the field of interest. Such detailed geological studies may include information which is stored in a computer database, the computer database being accessible, for example, via a remote computer or the like. Still further, petroleum engineering and geology departments of particular universities may also be available for assisting with a specific aspect of or obtaining certain input information for use in the engineered bit program of a given drilling program.

The engineered bit program can further include the use of automated design tools such as a computer aided design tool. The automated design tools can be used for the making of presentations to a customer. Presentations may be useful with respect to presenting the design of rock bit products which are being considered and/or selected for use in a particular engineered bit program. Where appropriate, a printer may also be used for providing a hard copy of the product designs at a customer site.

Lastly, the engineered bit program is a consolidation of all reports, analyses, graphs, designs, goals, and recommendations into a final presentation quality format for a given customer. For example, the deliverable end result or output of an engineered bit program of a drilling program may include a prescribed number of copies, for example ten (10) copies, of a binder with specific sections tabulated, for example, as follows: Geology, Drilling Analysis, Sample Analysis, Product Designs, and Recommendations. Additional sections may be added, as appropriate, for a particular engineered bit program.

The method and system apparatus of the present disclosure can thus be advantageously used to ensure that a well programming process implemented throughout a particular drilling company or other provider of drilling services is consistent and well organized. The bit planning/programming process as discussed herein relates to various aspects and details in the drill bit programming of a particular well drilling operation, for example, in a particular drilling field or fields of a given geographic area. In addition, by utilizing the bit planning/programming process as disclosed and defined herein, a provider of drilling services can more readily answer a customer's questions about the service provider's capabilities. In addition, the well programming process can be advantageously used as a guide to improve upon training of employees of the service provider, further with respect to understanding the skill and resource level requirements for a given level of engineered drilling bit program.

Figure 8:
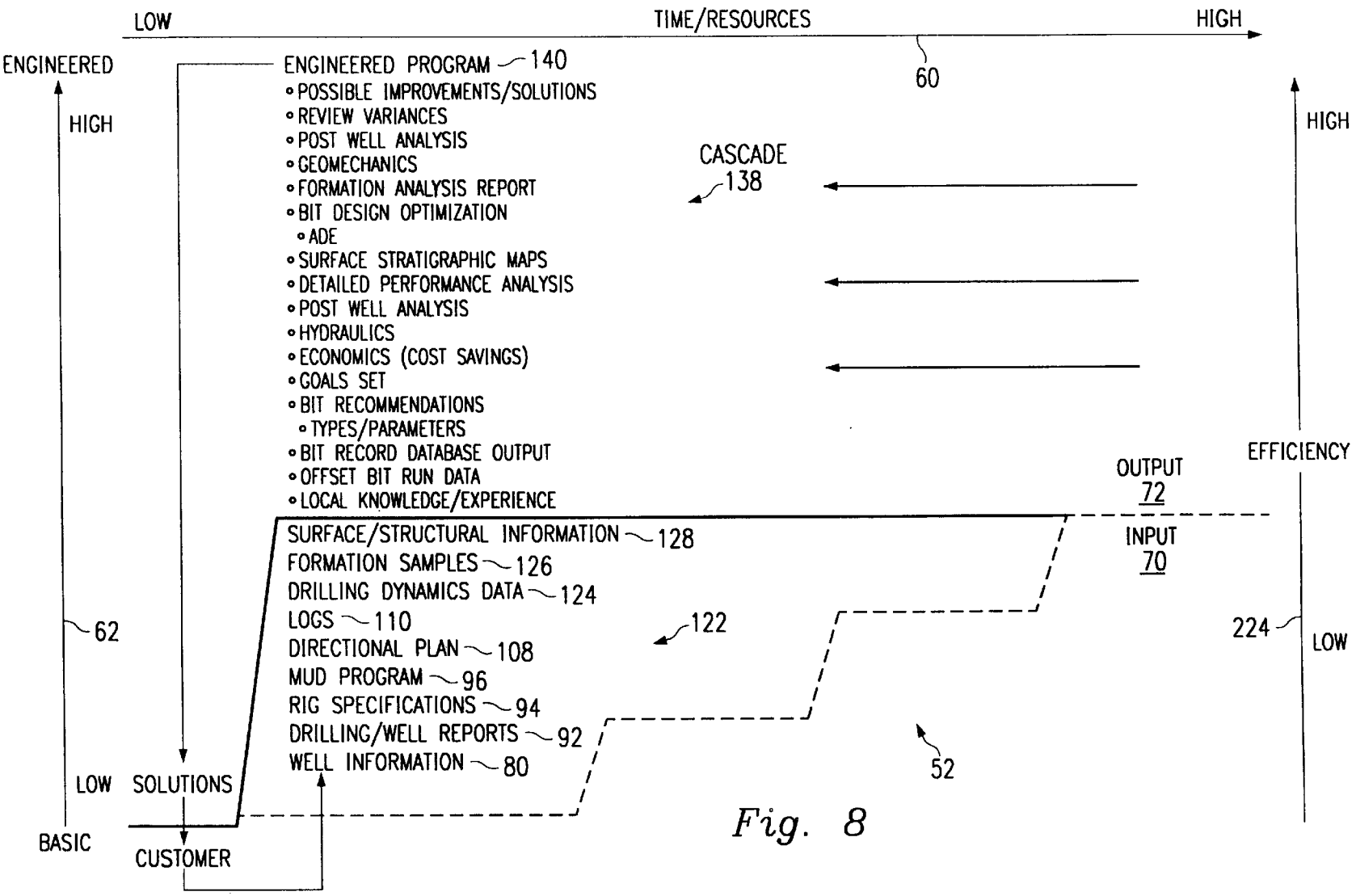
FIG. 8 is an illustration of efficiency of the cascaded method and system apparatus for engineering a drilling bit program according to the present disclosure.

FIG. 8 is an illustration of an efficiency of the cascaded method and system apparatus for engineering a drilling program according to the present disclosure. In particular, using a highest level 122 of planning phase 52, as well as a highest level of implementation phase and evaluation phase, in which each includes the use of in-house ADE and/or TA support, an amount of time needed for processing information input and developing engineered output 138 is greatly reduced. The planning phase inputs 70 and outputs 72 cascaded together form a level 4 service as specifically shown in FIG. 8. With the use of level 3 or level 4 service in comparison with using a level 1 service, the efficiency 224 of the CASCADE process is significantly increased. In addition, a time required for the engineering of a bit program, and in the obtaining of a successful drilling operation in which a given oil producing well of a plurality of wells is brought on-line, is reduced. The method and system apparatus of the present disclosure thus provides an increased efficiency of operation with the use of the highest levels of service in each phase. Furthermore, the use of the present method and apparatus is particularly advantageous for a customer development project, for example, of establishing on the order of one hundred wells over a three year period in a given geographic location. With the present method and apparatus, a given well may be completed and be brought on-line, i.e., to marketable production, on the order of 30 days versus 60 days (or more) with the use of prior methods. With the improved engineering of a bit program of the present disclosure, a gain of one month's oil production is possible, which further translates into millions of dollars of oil product being available at an earlier date for marketing. Alternatively, for a given period of time, with the use of the present method and system apparatus, one or more additional wells may be completed above and beyond the number of wells which would be completed using prior methods in the same period of time. In other words, drilling a new well in a lesser amount of time advantageously translates into marketable production at an earlier date.

While the invention has been particularly shown and described with reference to the preferred embodiment thereof, it will be understood by those skilled in the art that various changes in from and detail may be made therein without departing form the spirit and scope of the invention, as set forth in the following claims.

What is claimed is:

1. A method for engineering a drilling bit program linked to rock removal at a cutting element/formation interface and specific to drilling of one or more wells in a given geographic area, said method comprising the steps of:

planning the drilling of a particular well based upon a cascaded planning input and providing an engineered output which is a function of the cascaded planning input, a level of the engineered output being dependent upon a level of the cascaded planning input, wherein a prescribed level of the cascaded planning input includes both customer input and service provider input, the customer input including actual well information, wherein the engineered output can vary from a basic engineered output to a highly engineered output in response to a planning input range from a minimum level of planning input to a maximum level of planning input of the cascaded planning input, and further wherein for the prescribed level of cascaded planning input, the engineered output includes a prescribed cascaded output, the cascaded output including outputs in response to each successive level of planning input, up to the prescribed level of cascaded planning input;

implementing the engineered output in the drilling of the particular well based upon a cascaded implementation input and providing a cascaded implementation output which is a function of the cascaded implementation input, wherein the implementation output can vary from a basic implementation output to a highly engineered implementation output in response to an implementation input range from a minimum level of implementation input to a maximum level of implementation input of the cascaded implementation input, and further wherein for a prescribed level of implementation input, the cascaded implementation output includes outputs in response to each successive level of implementation input up to the prescribed level of implementation input; and evaluating the implementation of the engineered output for the drilling of the particular well based upon a cascaded evaluation input and providing an evaluation output which is a function of the cascaded evaluation input, a level of the cascaded evaluation output being dependent upon a level of the cascaded evaluation input, wherein the evaluation output can be used in said planning step as additional planning input for planning the drilling of a subsequent well in a geographic area, wherein the evaluation output can vary from a basic evaluation output to a highly engineered evaluation output in response to an evaluation input range from a minimum level of evaluation input to a maximum level of evaluation input of the cascaded evaluation input, and further wherein for a prescribed cascaded evaluation input, the cascaded evaluation output includes outputs in response to each successive level of evaluation input, up to the prescribed level of evaluation input.

2. The method of claim 1, wherein the cascaded planning input includes at least two levels, a first level of planning input characterized by a first amount of time and resource for providing a first level of engineered output and a second level of planning input characterized by a second amount of time and resource for providing a second level of engineered output, wherein the second amount of time and resource is greater than the first amount of time and resource.

3. The method of claim 1, wherein the cascaded implementation input includes at least two levels, a first level of implementation input characterized by a first amount of time and resource for providing a first level of implementation output and a second level of implementation input characterized by a second amount of time and resource for providing a second level of implementation output, wherein the second amount of time and resource is greater than the first amount of time and resource for implementing the engineered output during the drilling of the particular well.

4. The method of claim 1, wherein the cascaded evaluation input includes at least two levels, a first level of evaluation input characterized by a first amount of time and resource for providing a first level of evaluation output and a second level of evaluation input characterized by a second amount of time and resource for providing a second level of evaluation output, wherein the second amount of time and resource is greater than the first amount of time and resource.

5. A system for engineering a drilling bit program linked to rock removal at a cutting element/formation interface and specific to drilling of one or more wells in a given geographic area, said system comprising:

means for planning the drilling of a particular well based upon a cascaded planning input and providing an engineered output which is a function of the cascaded planning input, a level of the engineered output being dependent upon a level of the cascaded planning input, wherein a prescribed level of the cascaded planning input includes both customer input and service provider input, the customer input including actual well information, wherein the engineered output can vary from a basic engineered output to a highly engineered output in response to a planning input range from a minimum level of planning input to a maximum level of planning input of the cascaded planning input, and further wherein for the prescribed level of cascaded planning input, the engineered output includes a prescribed cascaded output, the cascaded output including outputs in response to each successive level of planning input, up to the prescribed level of cascaded planning input;

means for implementing the engineered output in the drilling of the particular well based upon a cascaded implementation input and providing a cascaded implementation output which is a function of the cascaded implementation input, wherein the implementation output can vary from a basic implementation output to a highly engineered implementation output in response to an implementation input range from a minimum level of implementation input to a maximum level of implementation input of the cascaded implementation input, and further wherein for a prescribed level of implementation input, the cascaded implementation output includes outputs in response to each successive level of implementation input up to the prescribed level of implementation input; and means for evaluating the implementation of the engineered output for the drilling of the particular well based upon a cascaded evaluation input and providing an evaluation output which is a function of the cascaded evaluation input, a level of the cascaded evaluation output being dependent upon a level of the cascaded evaluation input, wherein the evaluation output can be used by said planning means as additional planning input for planning the drilling of a subsequent well in the geographic area, wherein the evaluation output can vary from a basic evaluation output to a highly engineered evaluation output in response to an evaluation input range from a minimum level of evaluation input to a maximum level of evaluation input of the cascaded evaluation input, and further wherein for a prescribed cascaded evaluation input, the cascaded evaluation output includes outputs in response to each successive level of evaluation input, up to the prescribed level of evaluation input.

6. The system of claim 5, wherein the cascaded planning input includes at least two levels, a first level of planning input characterized by a first amount of time and resource for providing a first level of engineered output and a second level of planning input characterized by a second amount of time and resource for providing a second level of engineered output, wherein the second amount of time and resource is greater than the first amount of time and resource.

7. The system of claim 5, wherein the cascaded implementation input includes at least two levels, a first level of implementation input characterized by a first amount of time and resource for providing a first level of implementation output and a second level of implementation input characterized by a second amount of time and resource for providing a second level of implementation output, wherein the second amount of time and resource is greater than the first amount of time and resource for implementing the engineered output during the drilling of the particular well.

8. The system of claim 5, wherein the cascaded evaluation input includes at least two levels, a first level of evaluation input characterized by a first amount of time and resource for providing a first level of evaluation output and a second level of evaluation input characterized by a second amount of time and resource for providing a second level of evaluation output, wherein the second amount of time and resource is greater than the first amount of time and resource.

* * * * *